US005776018A

United States Patent [19]

Simpson et al.

[11] Patent Number: 5,776,018

[45] Date of Patent: Jul. 7, 1998

[54] BASKETBALL COLLECTION, PASSING AND SHOT ANALYSIS SYSTEM

[75] Inventors: John B. Simpson; John David Simpson, both of Woodside; Michael E. Dodson; Phillip T. Nash, both of Sunnyvale; Sung H. Kim, Palo Alto; Robert B. Brownell, Santa Clara; Ronald J. Smith, Menlo Park, all of Calif.

[73] Assignee: SoloPractice, Inc., Sunnyvale, Calif.

[21] Appl. No.: 747,921

[22] Filed: Nov. 12, 1996

Related U.S. Application Data

[60] Provisional application No. 60/006,918 Nov. 17, 1995, and provisional application No. 60/014,215 Mar. 27, 1996.

[51] Int. Cl.[6] ..... A63B 69/00

[52] U.S. Cl. ..... 473/433; 473/436; 473/447; 473/480

[58] Field of Search ..... 473/422, 431, 473/432, 433, 436, 447, 485, 489, 476, 481, 480, 100, 101

[56] References Cited

U.S. PATENT DOCUMENTS

| | | | |
|---|---|---|---|
| 3,776,550 | 12/1973 | McNabb . | |
| 4,579,340 | 4/1986 | Jenkins et al. . | |
| 4,678,189 | 7/1987 | Koss . | |
| 4,714,248 | 12/1987 | Koss . | |
| 4,913,431 | 4/1990 | Jakobs | 473/433 |
| 4,936,577 | 6/1990 | Kington et al. . | |
| 4,940,231 | 7/1990 | Ehler | 473/431 |
| 4,955,605 | 9/1990 | Goldfarb . | |
| 5,016,875 | 5/1991 | Joseph . | |
| 5,125,651 | 6/1992 | Keeling et al. . | |
| 5,312,099 | 5/1994 | Oliver, Sr. . | |

OTHER PUBLICATIONS

Brochure entitled "Sniper: The Ultimate Basketball Trainer," before Oct. 22, 1995, 5 pages including the cover letter.

*Primary Examiner*—Raleigh W. Chiu
*Attorney, Agent, or Firm*—Townsend and Townsend and Crew LLP

[57] ABSTRACT

A basketball passing machine (18) includes a basketball supply (20) which provides basketballs (48) for a basketball ejector assembly (26) which passes basketballs one-at-a-time in a controlled manner along a trajectory (70) towards a waiting player. The machine can be used with a collection net assembly (16) adjacent a backboard (6) so that basketballs from both made and missed shots are collected and directed into the basketball supply. The supply of basketballs allows the passing machine to pass basketballs to the player as fast as desired, such as every three to four seconds. Balls can be passed from the machine on demand; the pass rate, the azimuth of the trajectory, the speed of the ball and the number of balls placed in play at each position can be preprogrammed. Sensors (74, 104) are used to generate signals whenever a ball is placed in play and when a shot is made. Shooting accuracy and associated information can be displayed for a player as well as recorded for future reference.

44 Claims, 18 Drawing Sheets

BASKETBALL COLLECTION, PASSING AND SHOT ANALYSIS SYSTEM

CROSS-REFERENCE TO RELATED APPLICATIONS

This application claims the benefit of U.S. Provisional patent application No. 60/006,918 filed Nov. 17, 1995 for "Basketball Passing Machine and Shot Analysis System," and of U.S. Provisional patent application No 60/014,215 filed Mar. 27, 1996 for "Basketball Collection, Passing and Shot Analysis System," the disclosures of which are incorporated by reference.

BACKGROUND OF THE INVENTION

Basketball players often find that they do not get sufficient practice shooting baskets during normal team practices. Being a game which requires a great deal of skill, practice is critical to success in basketball. To get sufficient practice shooting, most players find that they must stay after team practice or practice shooting on their own. The problems with shooting baskets with or without a partner is that much time is spent chasing after loose balls rather than actually shooting the basketball.

Recognizing some of these problems, various types of basketball retrieval apparatuses have been designed. They typically include a basketball collection net which collects both made and missed shots and directs the basketballs back to the player. This can be accomplished by rolling the ball along an inclined path, such as shown in U.S. Pat. Nos. 5,016,875 to Joseph; 4,995,605 to Goldfarb; and 5,312,099 to Oliver Sr. The basketball can also be passed back to the player using a variety of ball passing devices, such as a pair of rotating heads shown in Koss U.S. Pat. Nos. 4,714,248 and 4,678,189; a solenoid-operated plunger shown in Jenkins U.S. Pat. No. 4,579,340; or the pivotal arm shown in McNab U.S. Pat. No. 3,776,550. Each of these inventions, while helpful, have been found to suffer from certain shortcomings.

Another problem confronting basketball players and their coaches is that information on shooting accuracy is not easily obtained or retained. The player generally ends up with only a vague recollection of how well or poorly he or she did during a practice session.

SUMMARY OF THE INVENTION

The present invention is directed to a basketball collection, passing and shot analysis system including a passing machine and a collection net assembly. The passing machine places balls in play by passing them to the player at virtually any chosen interval and over a range of distances. This is possible because the passing machine has a basketball supply holding at least 2, and preferably 4 or 5, basketballs.

The invention can, in one embodiment, be automatically or manually operated to change the azimuth of the trajectory and the distance of the pass so balls can be passed to different locations on the floor; this feature is especially useful for various basketball drills. Information regarding shooting accuracy can be collected, displayed and stored for immediate use and subsequent evaluation.

A variety of sensors can be used to determine when a shot is made, that is when a basketball passes through the basket, that is, through the hoop and net. One method uses a net support wire which is supported by the hoop and from which the net is suspended. When a basketball passes through the hoop and the net, the net is pulled downwardly by the basketball and therefore pulls downwardly on the support wire. This downward force is sensed by a suitable sensor coupled to the support wire, typically by sensing the momentary increase in tension in the support wire. The sensor creates a shot-made signal when this occurs.

Another method uses a shot-made basketball collector positioned to direct all basketballs which have passed through the hoop to the sensor. One type of a sensor uses a hinged, horizontally-extending paddle which is momentarily deflected by a basketball that has passed through the hoop. The shot-made basketball collector is preferably a downwardly and inwardly directed funnel-like structure positioned directly beneath the hoop.

The basketball passing machine includes a body to which a basketball supply and a basketball ejector assembly are mounted. The basketball supply has an entrance through which basketballs are introduced into a basketball supply region, typically a basketball magazine, defined within the basketball supply. The basketballs within the supply region pass from the entrance through to the ejector assembly. The basketballs are ejected or passed one at a time in a controlled manner along a trajectory towards a waiting player.

The basketball passing machine can be used alone anywhere on the basketball court to pass basketballs to one or more players. The basketball passing machine can also be used in conjunction with the basketball collection net assembly, which is positionable adjacent to a basketball backboard. The collection net assembly is preferably a stand alone structure or is constructed to be hung from the backboard. The basketball collection net assembly could also be mounted to the passing machine and positioned adjacent to the backboard. The collection net, being quite large, is preferably collapsible or easily disassembleable.

The collection net includes a frame and downwardly converging netting suspended from the frame. Basketballs from both made and missed shots are collected by the collection net and are directed through a discharge opening at the bottom of the collection net to the entrance of the basketball supply of the passing machine. By maintaining a supply of basketballs in the basketball supply machine, the passing machine can pass basketballs to the player as fast as desired, typically about one ball in play every three to four seconds. The speed at which the basketball is ejected along its trajectory can be changed to change the distance the basketball is passed. The type of pass, such as a lob pass or a direct pass, could also be changed by changing the elevation of the trajectory. Both the speed of the ball and the elevation of the trajectory could be changed to affect the type and distance of the pass.

The stand-alone collection net assembly preferably includes at least a support frame, which rests on the floor, a lift frame, which moves between a lowered, storage position and a raised, use position, and a collection net assembly mounted to and carried by the lift frame. In one preferred embodiment the collection net assembly is collapsible and includes a collapsible netting frame assembly and netting. The netting frame assembly is mountable to and dismountable from the lift frame to permit the collection net assembly to be separated from the lift frame to accommodate movement and storage. The collapsed, dismounted collection net assembly and the combination of the support and lift frames, when the lift frame is in the lowered position, are preferably sized and configured to pass through a conventional 80×32 inch doorway. This permits the components to be easily and efficiently moved and stored.

Preferably, the basketball is ejected using a pair of driving rollers, the speed of which are individually controlled so that the speed of and the spin imparted to the basketball can be controlled. The basketball supply and basketball ejector assembly are preferably mounted to a turntable so that the trajectory azimuth can be varied.

A ball-in-play sensor is preferably used to generate an appropriate signal when a ball is placed in play, that is passed to a player. Information from the ball-in-play sensor and the shot-made sensor can be displayed for a player as well as printed and/or electronically recorded for future reference.

The parameters relating to placing the basketballs in play can be adjusted and preprogrammed. For example, a chosen number of balls, such as 100, can be placed in play from a preselected position on the court, such as the top of the key, at a preselected interval, such as one ball passed to the player every three and a half seconds, during what is termed volume shooting. This permits a 100 shot session to be conducted in only about ten minutes. The balls can also be passed to the player on demand during what is termed manual volume shooting.

The rate at which balls are placed in play, the azimuth of the trajectory, the speed of the ball leaving the ejector assembly (and thus the distance of the pass) and the number of balls placed in play at each position can be preprogrammed for what is called drills. Drills can be specialized drills or conventional drills, such as the 25 shot drill whereby a player shoots from 5 different positions along the 3-point line; the player keeps shooting until he or she makes 5 shots from a position before moving to the next position.

An advantage of the invention lies in its flexibility. Providing a ball supply with a sufficient capacity permits balls to be passed to the player as quickly as desired without interruption. It has been found that a ball supply of at least two balls, and preferably about four to five balls, is desired to ensure a ball is always ready to be passed to the player at a realistic maximum rate of 3.5 seconds between passes and thus between shots. For team drills, that is where more than one player is shooting, the interval between passes may be reduced substantially below the rate of 3.5 seconds between passes; in such cases it may be desired to configure the ball supply to hold more than five balls. The speed of discharge of the basketball along the trajectory can be adjusted and the azimuth of the trajectory can be adjusted so that shots can be taken from many different places on the floor. Shooting information can be provided to the player through a display panel, typically carried by the passing machine, as well as by being recorded for future use. For example, a simplified printout, much like a cash register receipt, could be automatically printed out at the end of each drill or session. More elaborate printouts can also be created.

Other features and advantages of the invention will appear from the following description in which the preferred embodiments have been set forth in detail in conjunction with the accompanying drawings.

DESCRIPTION OF THE PREFERRED EMBODIMENT

Figure 1:
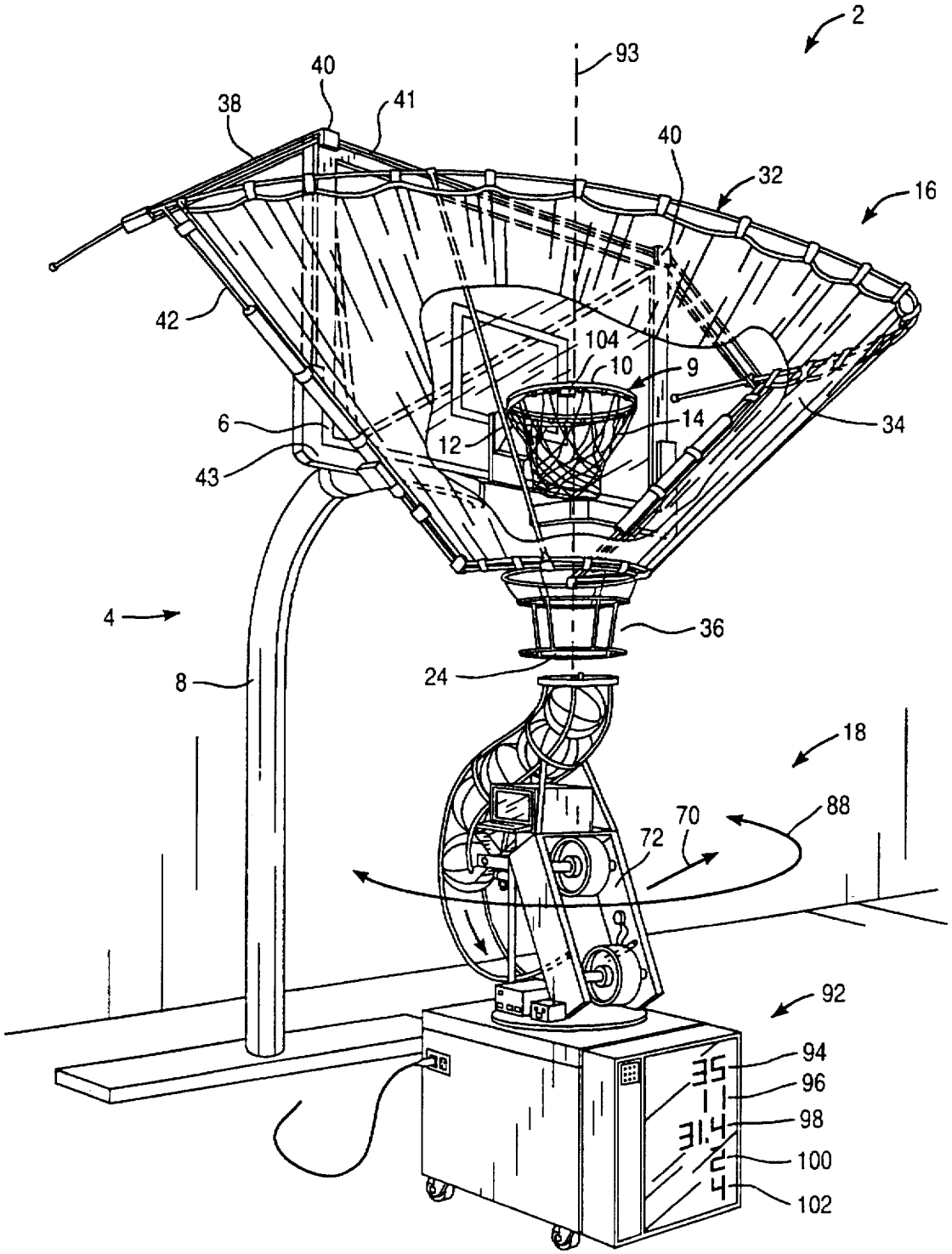
FIG. 1 is a perspective view of a basketball collection, passing and shot analysis system made according to the invention with a collection net hung from a backboard and a passing machine positioned beneath the discharge opening of the collection net.

FIG. 1 illustrates a first basketball collection, passing and shot analysis system 2 made according to the invention. System 2 is shown in use with a backboard assembly 4 including a backboard 6 mounted to a backboard support 8. Backboard assembly 4 also includes a basket 9, basket 9 including a basketball hoop 10, mounted to backboard 6 by a bracket 12, and a net 14 suspended from hoop 10. Backboard assembly 4 is conventional.

System 2 includes a collection net assembly 16 which is mounted to and supported by backboard 6 and a basketball passing machine 18 shown positioned directly beneath collection net assembly 16 in FIG. 1. Machine 18 can be used at other positions as well. Basketball passing machine 18 includes broadly a basketball supply 20 having an entrance 22, positioned directly beneath a basketball discharge opening 24 of collection net assembly 16, and a basketball ejector assembly 26. Both supply 20 and assembly 26 are mounted to and supported by body 28 of passing machine 18 through a turntable 30. Body 28 is supported by lockable caster wheels 31 to permit machine 18 to be easily positioned on the basketball court and then secured in place.

Figure 3:
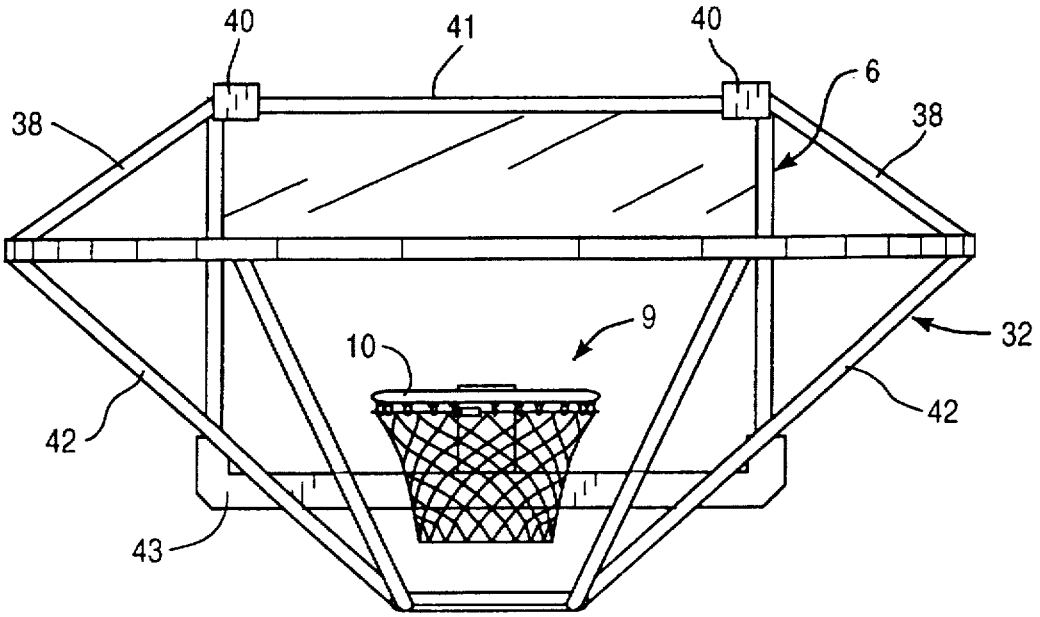
FIG. 3 is a front view showing the frame of the collection net of FIG. 1 mounted to a backboard.
Figure 4:
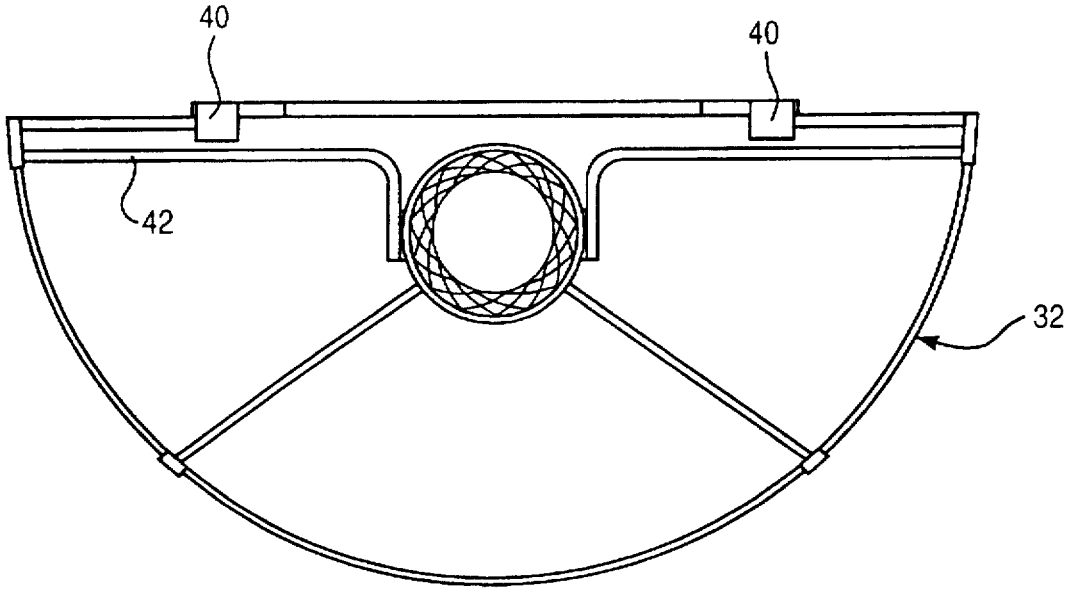
FIG. 4 is a top-plan view of the frame of the collection net of FIG. 3 without the backboard or the basket.

Collection net assembly 16, see FIGS. 1, 3 and 4, includes a funnel-like collection net frame 32 which supports netting 34. Frame 32 includes a basketball discharge guide 36 at its lower end, discharge guide 36 defining discharge opening 24. Frame 32 includes a pair of angled support bars 38 and a pair of backboard clips 40 at the upper ends of support bars 38 sized to suspend collection net assembly 16 from the upper edge 41 of backboard 6. Frame 32 has a pair of downwardly and inwardly directed supporting arms 42 which rest against backboard 6 adjacent to its lower corners 43. Collection net assembly 16 can thus be easily and simply mounted to backboard assembly 4 by simply placing clips 40 over the upper edge 41 of backboard 6 and permitting arms 42 to rest against the backboard at corners 43. Collection net assembly 16 is positioned and sized so that both made shots, that is shots passing through basket 9, and missed shots will be collected within the collection net assembly and passed through discharge guide 36, and thus into entrance 22 of basketball supply 20.

While use of collection net assembly 16 may, at first glance, be thought to be distracting to the player, it has been found that after just a few shots, the player becomes comfortable with it. This is because the player is provided a clear view of basket 9 through net 14 and also because the normal arc provided a properly shot basketball easily clears the collection net. Use of collection net assembly 16 is not, of course, appropriate for the layups or low post shots. To permit shooting of low post shots, that is shots taken about 0 to 12 feet from basket 9, measured horizontally, openings can be provided in the collection net 4; as an alternative, the upper portion of collection net 4 can be folded downwardly to permit such close-in shooting.

Figure 2:
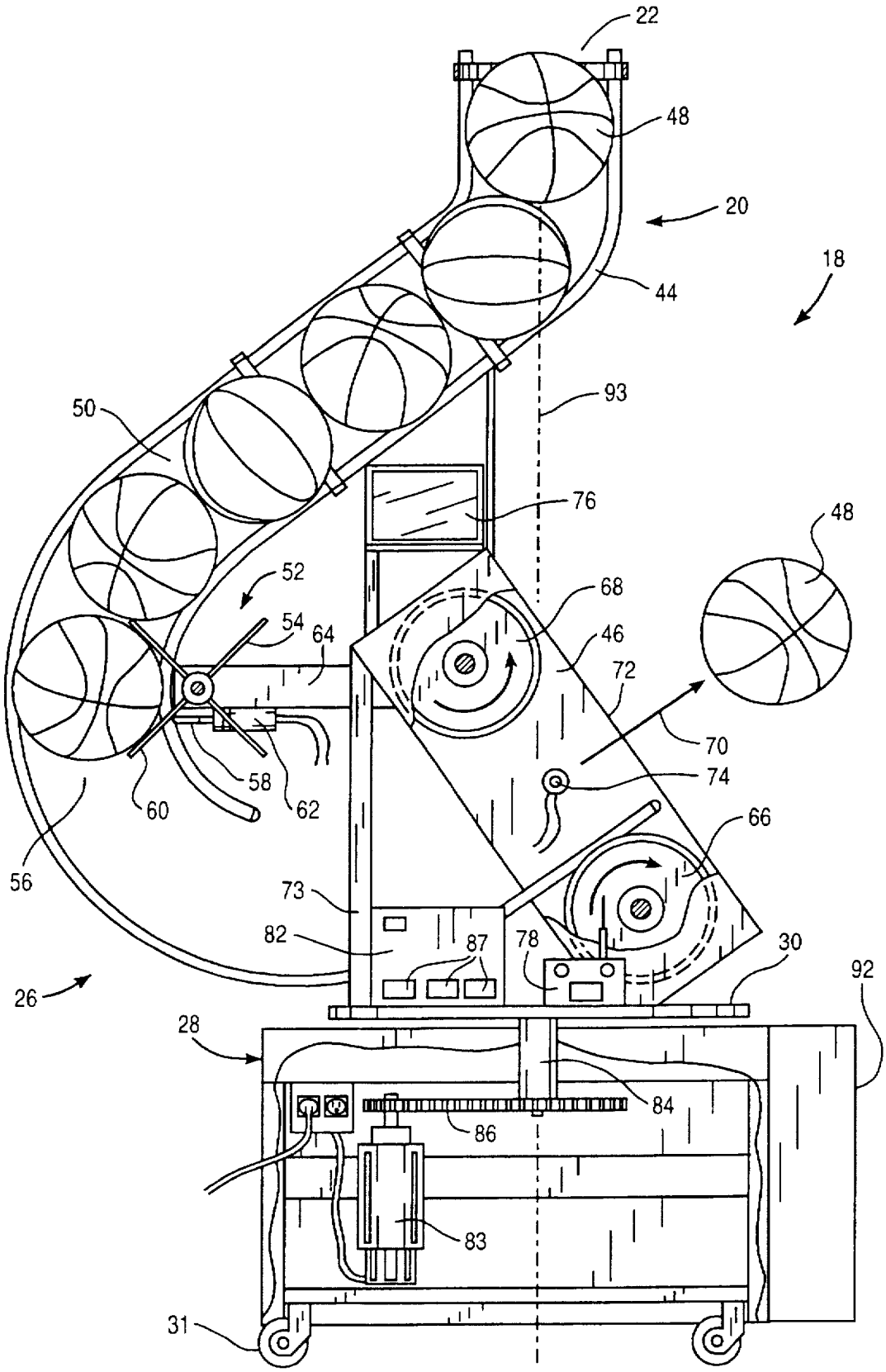
FIG. 2 is an enlarged side view of the passing machine of FIG. 1 with portions broken away to illustrate its operation.

Referring again to FIGS. 1 and 2, basketball supply 20 is seen to include a basketball guide frame 44 extending from entrance 22 to an outlet 46 of basketball ejector assembly 26. Guide frame 44 is sized to provide for storage of at least five basketballs 48 along a basketball supply region 50. Basketball supply 20 acts like a magazine since the balls are arranged in a line. Basketball supply 20 could be arranged in other manners to permit additional basketballs 48 to be housed within basketball supply region 50. For example, basketball supply 20 could include a magazine-like supply region such as shown in FIG. 2 in conjunction with a basketball hopper above entrance 22; the hopper would be designed to prevent basketballs from clogging the hopper. This would be especially advantageous when basketballs 48 are being passed to several players during a team drill. Additional quantities of basketballs could also be stored if one were to resort to the use of mechanical lifting devices as a part of the basketball supply. However, to ensure that a basketball 48 is always available for being placed in play by ejector assembly 26 under normal conditions for volume shooting by a single player, that is with a ball passed to a player as fast as every 3.5 seconds, it is desired that basketball supply 20 hold at least 2, and preferably 4 to 5, basketballs.

Basketball ejector 26 includes a basketball metering assembly 52. Metering assembly 52 includes a rotatable paddle wheel 54 positioned to interact with basketballs 48 as they reach an exit 56 of basketball supply 20. Paddle wheel 54 is prevented from rotation when a movable stop 58 engages one of the arms 60 of paddle wheel 54. Stop 58 is spring-biased to the position of FIG. 2 which prevents rotation of paddle wheel 54. Stop 58 can be retracted by the actuation of a solenoid 62 connected to stop 58. Paddle wheel 54 rotates freely in the counterclockwise direction in FIG. 2; rotation in the clockwise direction is prevented to help keep arms 60 from improperly engaging subsequent basketballs 48. Both paddle wheel 54 and solenoid 62 are mounted to and supported by a support frame arm 64. Actuation of solenoid 62 is for a length of time sufficient to permit one arm 60 to pass stop 58 but prevent the trailing arm from passing stop 58. This causes the next basketball 48 in line to assume the position adjacent to exit 56 of basketball supply 28. The release of a basketball 48 through exit 56 by the actuation of solenoid 62 permits the basketball to roll along basketball guide frame 42 with sufficient speed so that the basketball reaches the position between two passing rollers 66, 68.

Passing rollers 66, 68 are each independently driven at chosen speeds to cause basketball 48 to be passed at an initial speed along a trajectory 70 to the player. Passing rollers 66, 68 are covered with an elastomeric material, such as one-half inch thick urethane to provide a good grip on basketball 48. Typically, upper passing roller 68 is rotated at a somewhat slower rate than lower passing roller 66 to provide ball 48 with a slight back spin, which is preferred by basketball players. The slight back spin mimics a conventional pass from another player. Of course, the basic speed at which passing rollers 66, 68 are rotated determines the initial speed of basketball 48 and thus the length of the pass to the player. Increasing the speed increases the distance of the pass and thus the distance the player taking the shot can be from basket 9. This distance could also be adjusted by varying the elevation of trajectory 70 above a horizontal; however, an initial elevation of about 30 ° has been found to work well for passing distances of about 10 feet to 20feet.

Passing rollers 66, 68 are supported between a pair of plates 72, the upper ends of the plates being supported by a pair of support columns 73. The lower ends of the plates 72 and the support columns 73 are supported on turntable 30. An infrared ball-in-play sensor 74 is mounted on plates 72 (a receiver and transmitter on one plate 72 and a reflector on the other plate 72) and is used to provide a ball-in-play signal each time a basketball 48 is placed into play by being ejected along trajectory 70 from ejector assembly 26.

Figure 5:
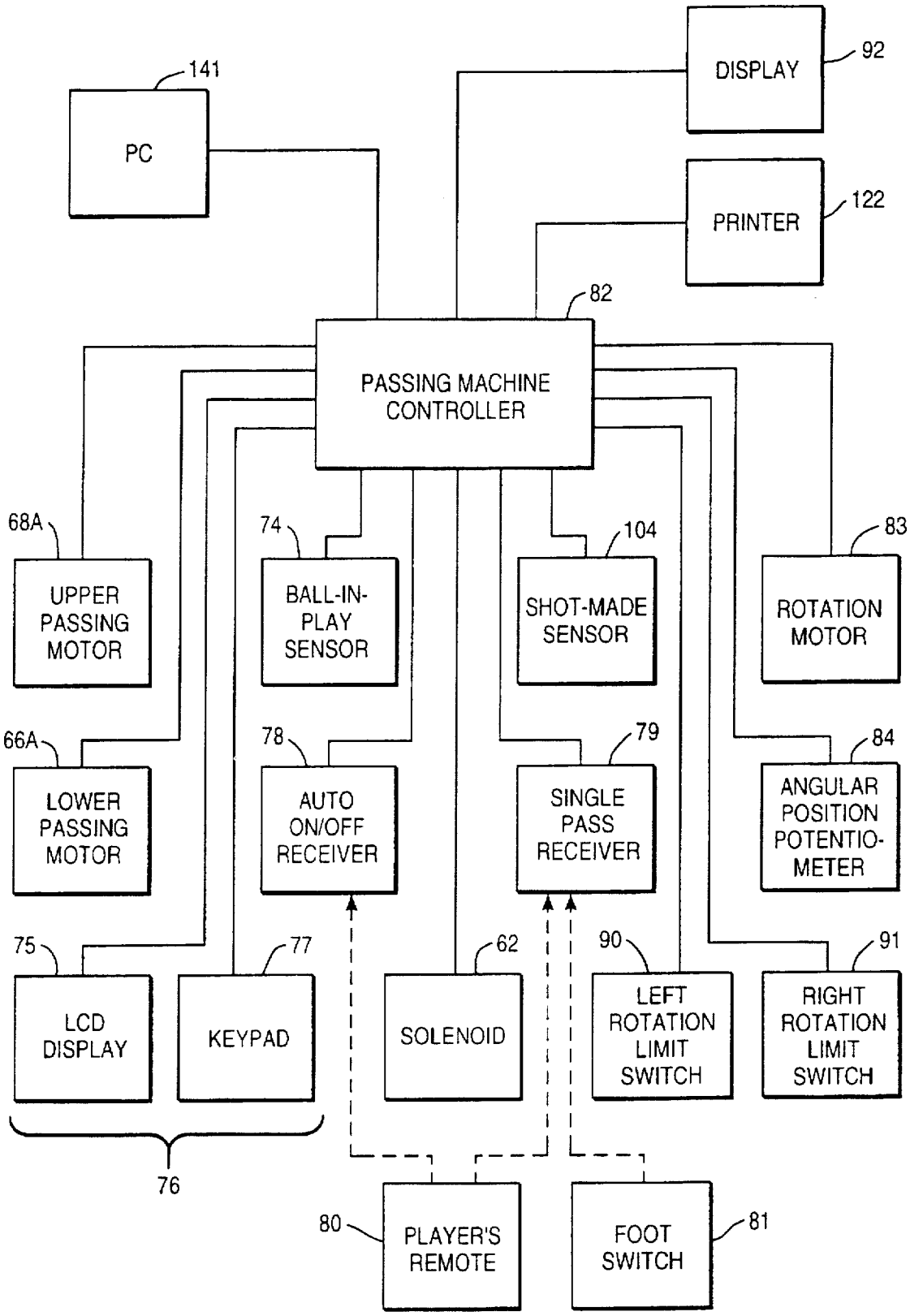
FIG. 5 is a schematic block diagram showing the relationship of various components to the controller.

A flat panel input 76, see FIGS. 2 and 5, including an LCD display 75 and a keypad 77, is positioned between passing roller 68 and guide frame 44 and is used to input the desired information regarding the type of use to which system 2 is to be put. This will be described in more detail below. Supported by turntable 30 are a pair of receivers 78, 79 used in conjunction with a player's remote controller 80 and a remote control foot switch 81. Player's remote controller 80 is configured to be worn by a player and includes a first button which activates/deactivates automatic on/off receiver 78, used for automatic passing of ball during volume shooting, and a second button which actuates solenoid 62 through single pass receiver 79, causing a single basketball 48 to be passed to the player each time the second button is pressed. Other methods for inputting the interval between passes can be used as well.

The various operations of machine 18 are controlled by a controller 82 mounted to turntable 30. Controller 82 could, of course, be positioned elsewhere, such as within body 28. Controller 82 is a Motorola 68HC11 microcontroller with peripheral circuitry; other microcontrollers or analog systems of control could also be used. Turntable 30 is rotated through the actuation of a rotation motor 83 coupled to a turntable drive shaft 84 by a gear and chain drive train 86. The azimuth 88, see FIG. 1, of trajectory 70 can be changed manually by actuating one or more of the buttons/switches 87 on controller 82; doing so causes motor 83 to rotate turntable 30 through gear and chain drive train 86 and turntable drive shaft 84. Controller 82 is provided information on the azimuth 88 of trajectory 70 from an angular position potentiometer 89. The rotation of turntable 30 is limited to a total arc of about 180° by the use of left and right rotation limit switches 90, 91. While the azimuth 88 and the speed of ball 48 as it exits outlet 46 of ejector assembly 26 could be remotely controlled, in practice both of these variables are inputted through input 76.

Turntable 30 rotates about a vertical axis 93 which passes through the center of entrance 22 of supply 20. This ensures that when used with collection net assembly 16, entrance 22 remains beneath opening 24 of net 16 regardless of the azimuth 88 of trajectory 70.

Passing machine 18 includes a display 92 which provides the player with five fields of information, specifically the number of balls in play field 94, the number of shots made field 96, the percentage of shots made field 98, the current made shot streak field 100 and the longest made shot streak field 102. The number of balls in play is determined by ball-in-play signals from sensor 74. The number of shots made is determined by a shot-made signal produced by a shot-made sensor 104 positioned adjacent basket 9. In the preferred embodiment, sensor 104 senses the presence of a ball 48 passing through hoop 10 and net 14 by sensing downward movement of net 14. Other types of sensors, such as sensors using one or more infrared beams, ultrasonic sensors, physical contacts, capacitance sensors, etc., could also be used. Sensor 104 is preferably hardwired to controller 82, but could be made to be remotely coupled to controller 82 as well.

Figure 1A:
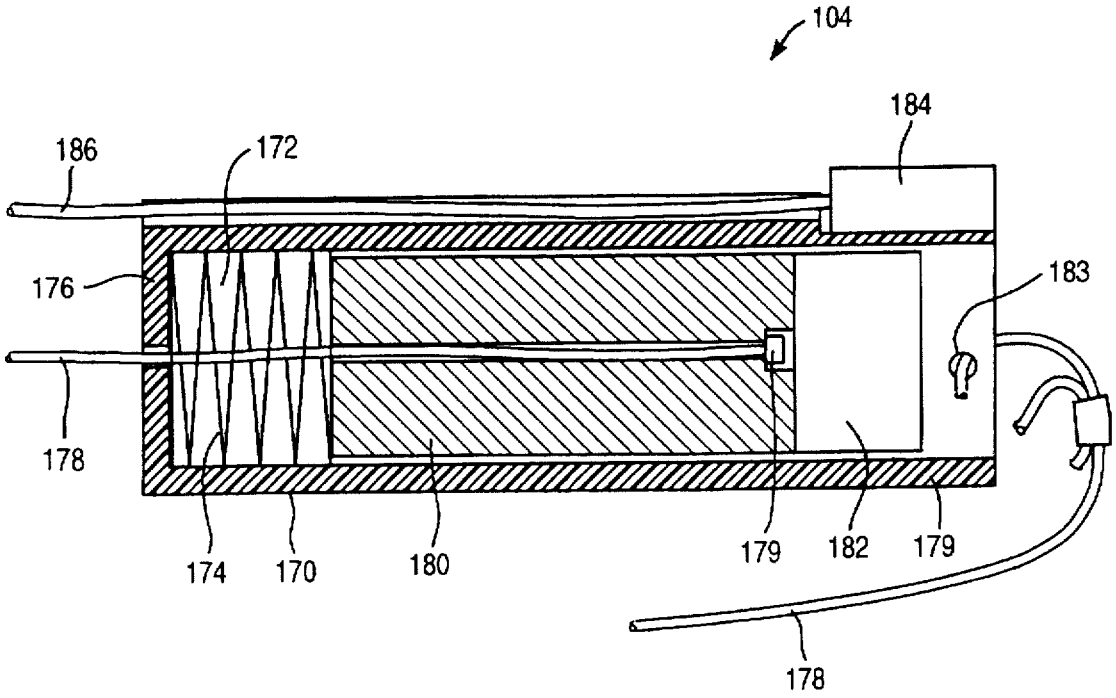
FIG. 1A is a simplified cross-sectional view of a shot-made sensor mounted adjacent the basket of FIG. 1.

FIG. 1A illustrates in simplified form shot-made sensor 104. Sensor 104 includes a cylindrical casing 170 having a hollow interior 172 and housing a compression spring 174 at its first end 176. A flexible net support wire 178 is connected to a cylindrical aluminum slug 180 at one end using a brass keeper 181 crimped to the end of wire 178. The other end of wire 178 is passed through a pair of holes 183 formed in a second end 179 of casing 170 so that pulling on wire 178 causes aluminum slug 180 to compress spring 174. A permanent magnet 182 is secured to the outer face of aluminum slug 180 and moves with the aluminum slug. Wire 178 passing through holes 183 also acts to limit the movement of magnet 182 away from end 176. A Hall sensor 184 is mounted to casing 170 opposite magnet 182. The movement of magnet 182 within interior 172 of case 170, caused by pulling on wire 178, is sensed by Hall sensor 184 and this signal is communicated to controller 82 through conductors 186.

Figure 1B:
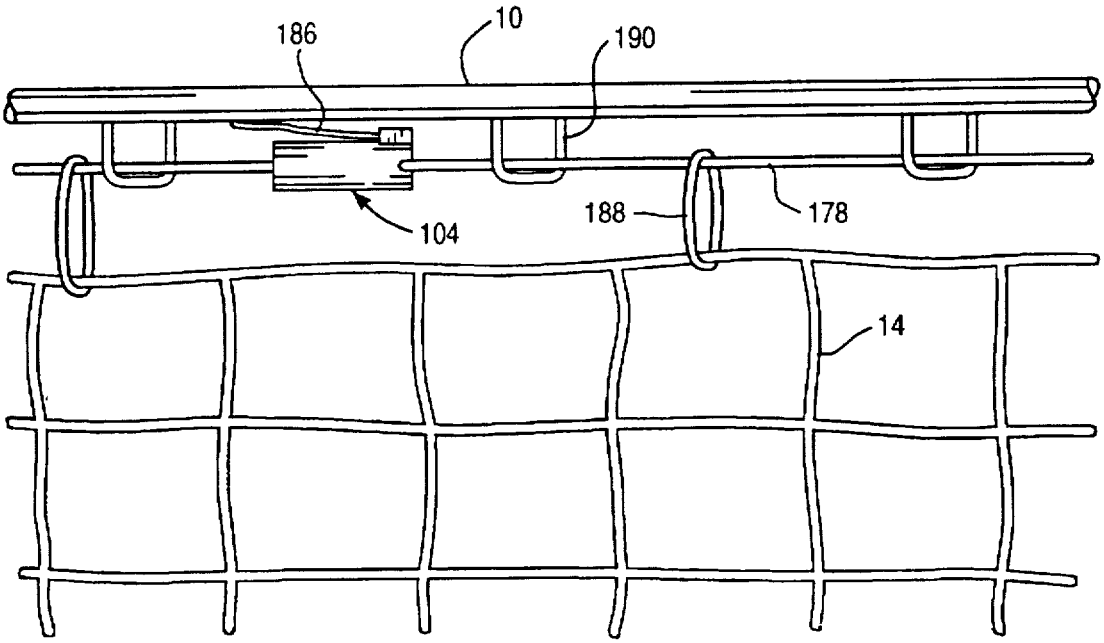
FIG. 1B is an enlarged view showing how the net is suspended from the hoop by the support wire of FIG. 1A.

Conventionally, net 14 is suspended from hoop 10 using net loops 188, see FIG. 1B, engaging hooks 190 extending from hoop 10. With shot-made sensor 104, wire 178 is supported by hooks 190 and net loops 188 are suspended from wire 178. Sensor 104 is suspended by wire 178 between two adjacent hooks 190. In this way when a basketball 48 passes through hoop 10 and net 14, basketball 48 pulls downwardly on net 14 causing net 14 to pull downwardly on wire 178 thus causing wire 178 to be placed in tension. This causes wire 178 to pull aluminum slug 180 towards first end 176 against the bias of spring 174 thus moving magnet 182 away from Hall sensor 184. This movement of magnet 182 causes Hall sensor 184 to create an appropriate signal along conductors 186 indicating a basket has been made. Shot-made sensor 104 is constructed so that relatively minor forces on net 14 will not cause magnet 182 to move sufficiently to create a shot-made signal from Hall sensor 184, such as could occur if the basketball does not go through hoop 10 but rather brushes against net 14 on its way downwardly through collection net assembly 16.

Figure 6:
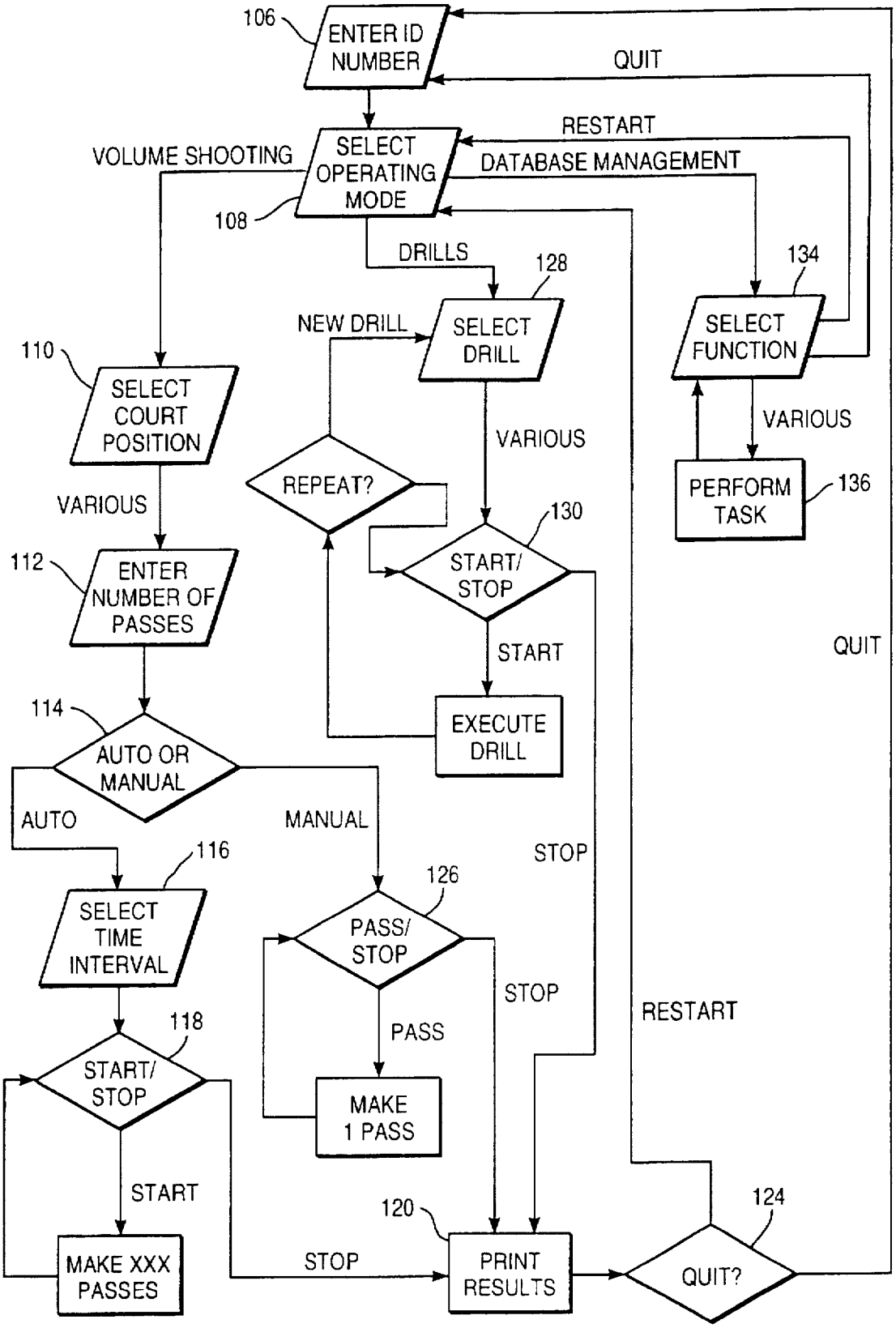
FIG. 6 is a high level flow chart showing possible decisions made for volume shooting, drills and database management.

FIG. 6 illustrates how a user can program controller 82 by using flat panel input 76 to provide the desired pattern of play. Input 76 first asks for an I.D. number or name at 106 and then for the desired operating mode at 108. If volume shooting is selected, that is shooting a number of shots from the same position, the position on the court from which the shots are to be taken is then selected at 110. In the preferred embodiment, eight different court positions for shooting, specifically five around the 3-point line, one at the free throw line and two 2-feet on either side of the free throw line, are preprogrammed into controller 82. After the desired court position has been selected, the number of passes to the player is entered at 112. Next, the player selects whether the passes are to be made manually or automatically at 114. If the passes to the player are to be made automatically, the player must select the time interval at 116, such as one pass every 3.8 seconds. At this point, all inputting is done so the player moves to the chosen position on the court and after a preprogrammed time, such as 8 seconds, controller 82 begins actuating solenoid 62 at the selected time interval. After the selected number of passes have been made, decision point 118 causes the volume shooting session to stop at which time the results are printed at 120 in printer 122. The player then has the option of terminating the session or beginning another session at quit decision point 124. If the manual mode were chosen at the auto or manual input 114, a pass is made at pass/stop decision point 126 whenever single pass receiver 79 provides a suitable signal to controller 82 so long as the number of passes input at 112 has not been reached. Once that number has been reached, the results are printed at 120 and the session is terminated or another session is begun from quit decision point 124.

Returning to select operating mode input 108, if a drills session is selected, the user then selects the particular drill at 128. The player or players then move to the proper position or positions on the court; after an appropriate length of time, such as 8 to 10 seconds, controller 82 begins operating basketball passing machine 18 to cause basketballs 48 to be passed to the preselected position(s) on the court. Once the drill has been completed, start/stop decision point 130 halts the drill and causes printer 122 to print the results at 120. At quit decision point 124 the player can return to select operating mode decision point 108 or quit the session and return program control to the start of the program, that is at enter I.D. number decision point 106.

The last operating mode selection at decision point 108 is the database management mode which when selected permits the player to select the function at 134, such as add or delete players to or from database and review summary statistics for one or more players on a team. Controller 82 then performs the various tasks at 136 after which control is either returned to 108 to continue or back to decision point 106 when the session is ended.

Figure 7:
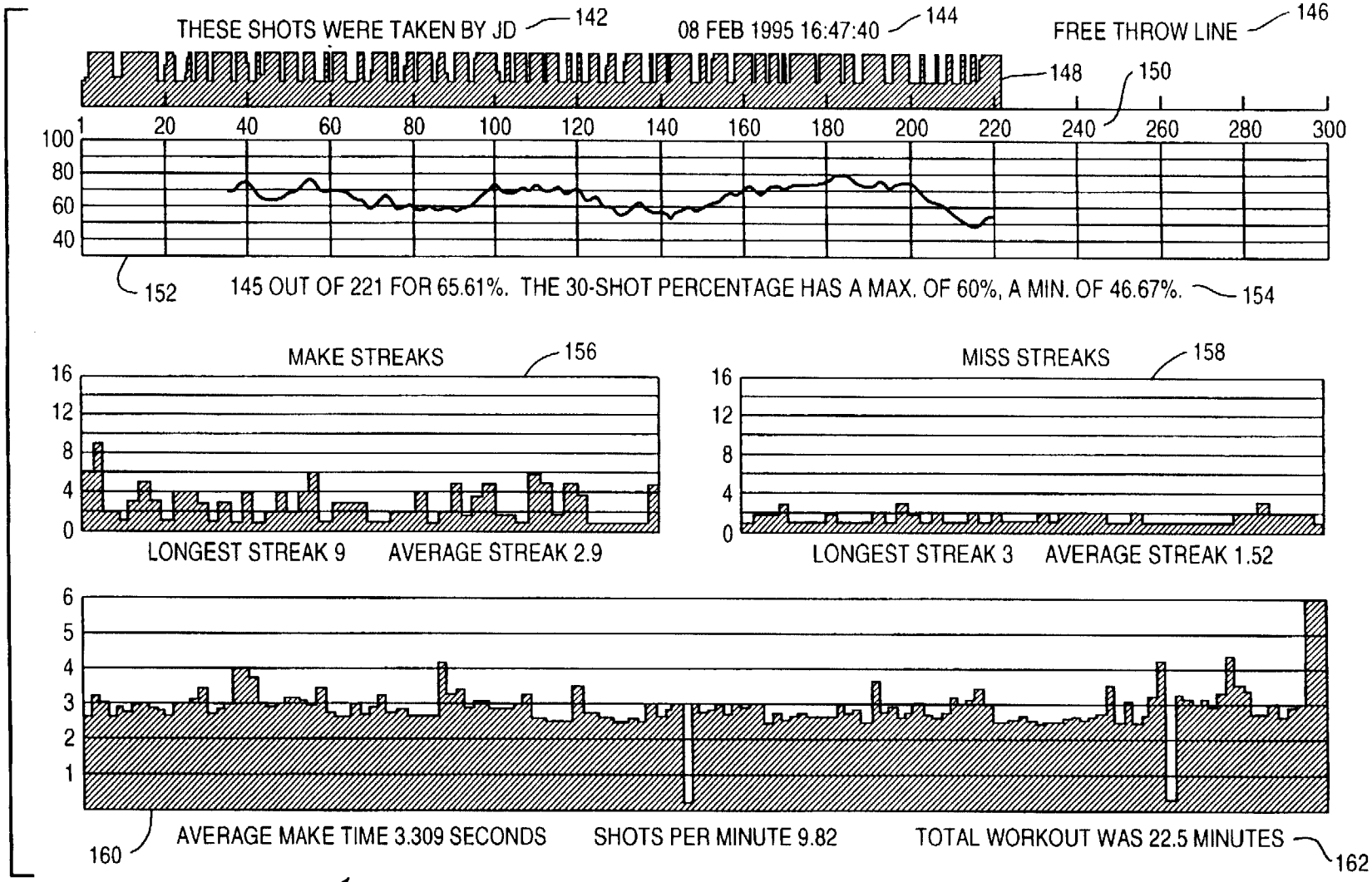
FIG. 7 is a sample printout showing information from a practice session.

FIG. 7 illustrates a sample printout 140 created by computer 141 and either displayed on a monitor, not shown, or printed using printer 122. Printout 140 includes the user I.D. 142, the date and time of the session 144 and the session type 146 along the top of the printout. In the disclosed example, the session was a volume shooting session from the free throw line. Graph 148 shows the made and missed shots out of a total of 221 shots. A common scale 150 is used for both graph 148 and a 30-shot running total graph 152. Graph 152 plots a percentage of made shots for the previous 30 shots. Therefore, the percentage of made shots indicated by the graph at, for example, 60 shots, counts all shots made from 31 through 60 and then plots the percentage made, in this case 70%. A summary line 154 summarizes the information from graphs 148 and 152. In FIG. 7, summary line 154 states that 145 shots were made out of 221 attempted for a shooting percentage of 65.61%. The thirty shot percentage has a maximum percentage of 80% made, which appears to have taken place around shot number 181, and a minimum percentage of 46.67% made, which appears to have taken place about shot 215. The make streaks graph 156 and miss streaks graph 158 are also shown with their corresponding longest and average streaks indicated beneath the graphs. The final graph 160 is a plot of the time interval between when a basketball 148 passes ball-in-play sensor 74 and made shot sensor 104 for each made shot. Missed shots are not included in graph 160 since they are not counted by shot-made sensor 104. Summary line 62 indicates that in this case the average time for the made shots was 3.3 seconds and there were approximately 9.82 made shots per minute over a total workout time of 22.5 minutes.

As can be appreciated, any of this information can be printed out or displayed for immediate analysis and use and, if desired, stored for future reference. Both the player and the coach can use this information to help tailor workouts to the maximum advantage. For example, information from graph 152 suggests that after about 200 shots, the player's efficiency decreased substantially. That may have been due to being overtired or a lack of concentration, or both. Also, printouts 140 from different positions can be compared to see which position the player needs to work at the most. Information from the beginning of the season to the end of the season can be compared to help decide if more or less shooting practice should be conducted during the playing season as opposed to between seasons. To one of ordinary skill in the art, such data can be used for many other purposes so the invention can provide the user with a powerful tool.

Figure 8:
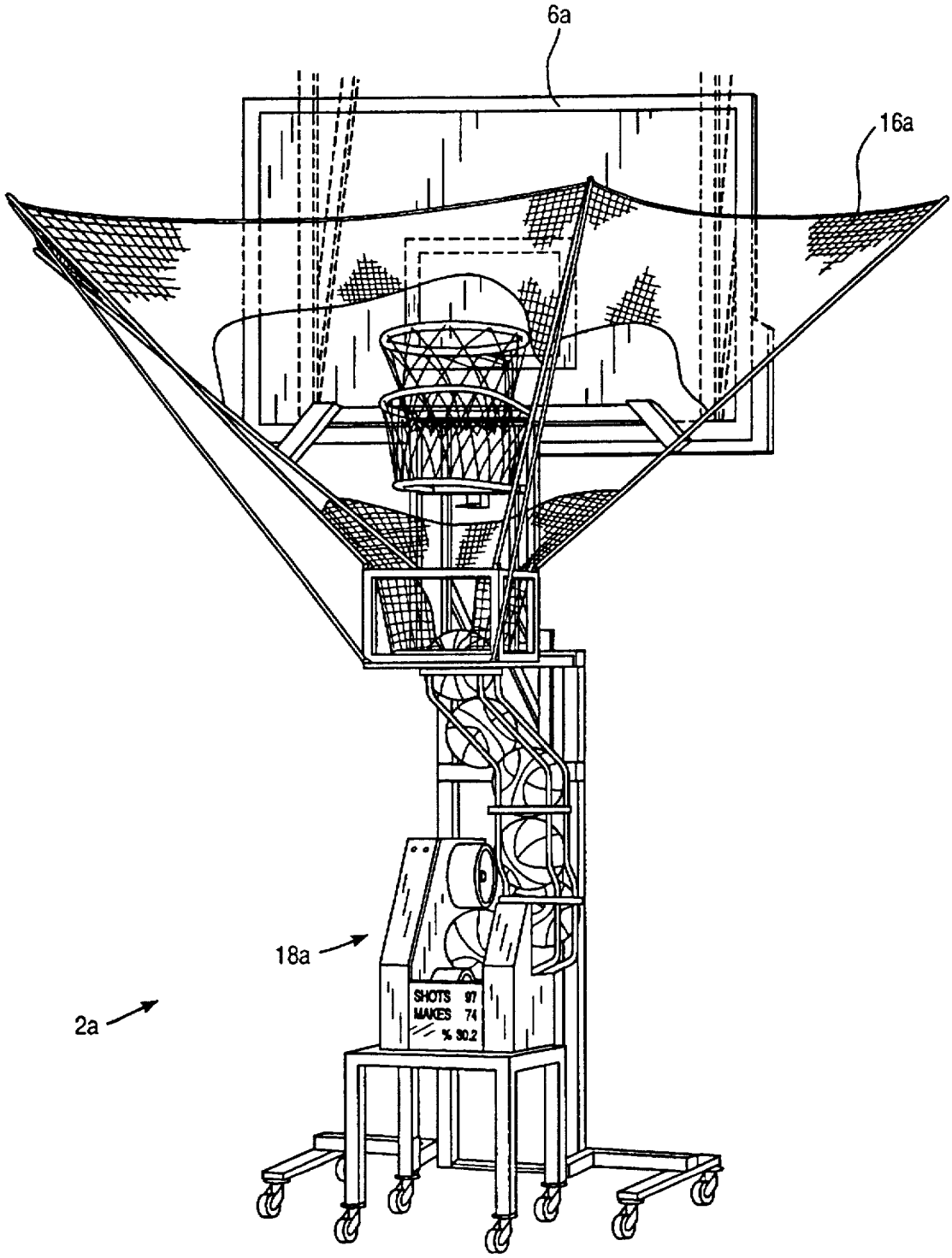
FIG. 8 is a perspective view of an alternative embodiment of the basketball collection, passing and shot analysis system of FIG. 1.
Figure 9:
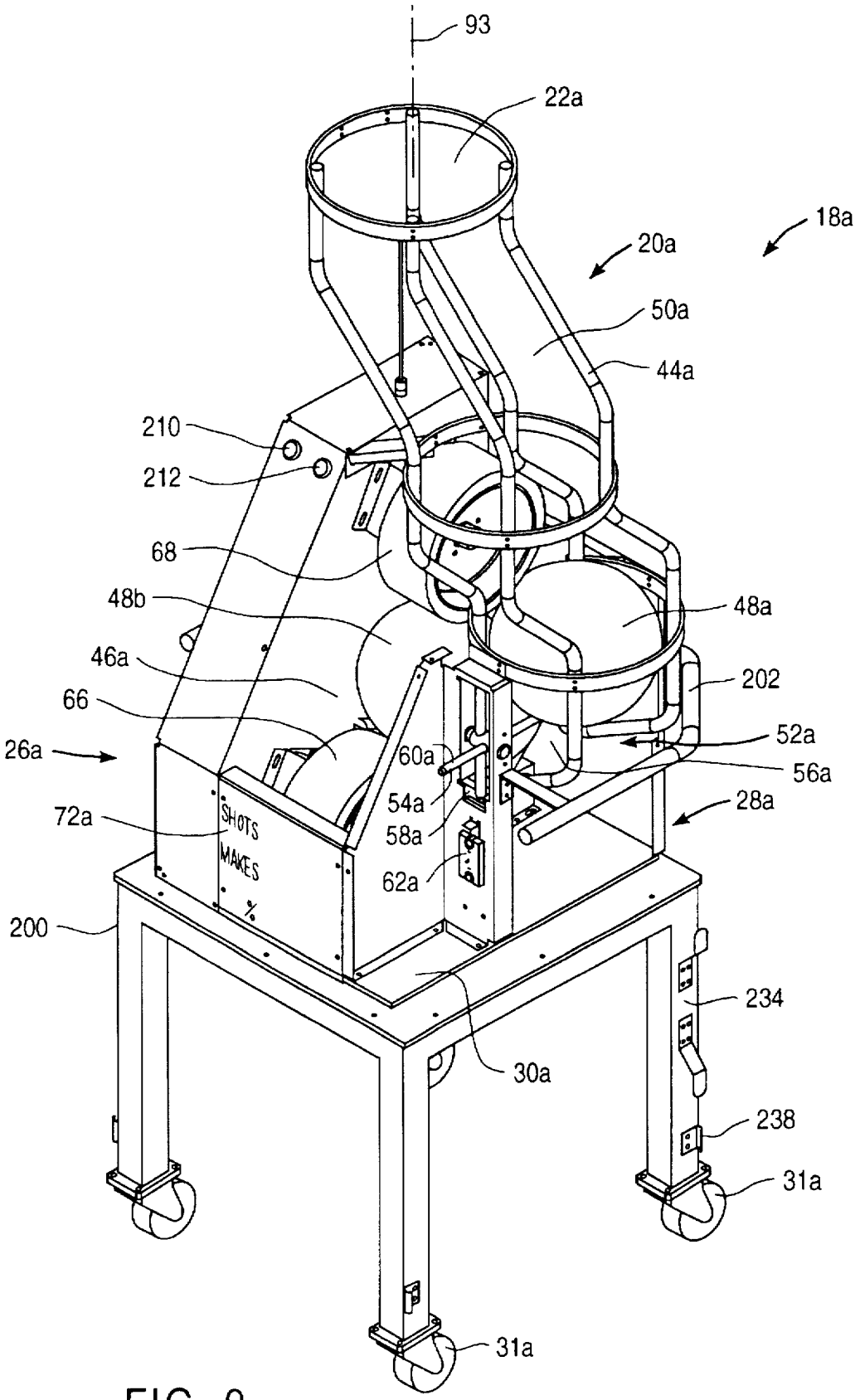
FIG. 9 is an isometric view of the passing machine of FIG. 8 with a side panel removed to illustrate various mechanisms.
Figure 10:
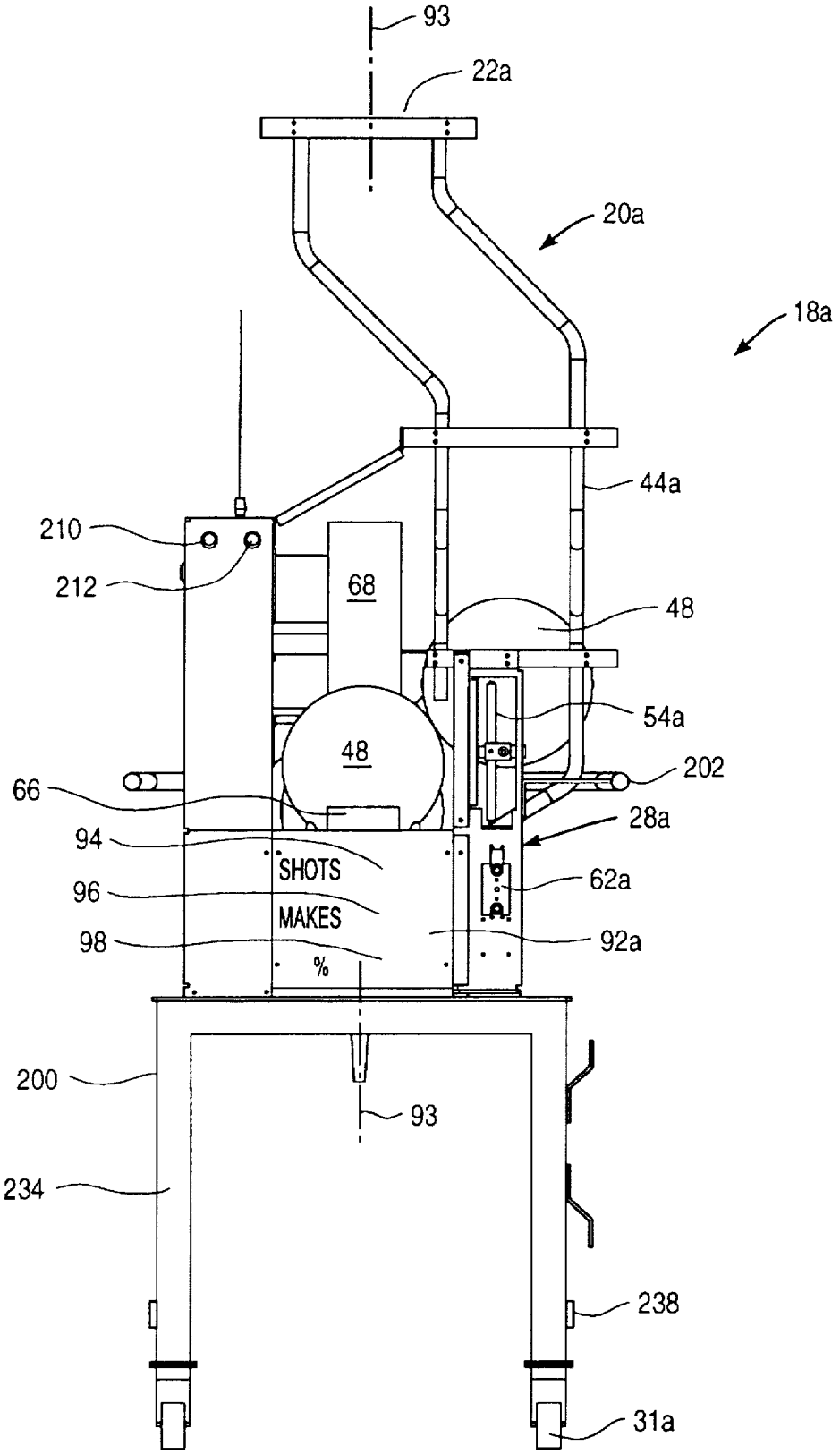
FIG. 10 is a front view of the passing machine of FIG. 9.
Figure 11:
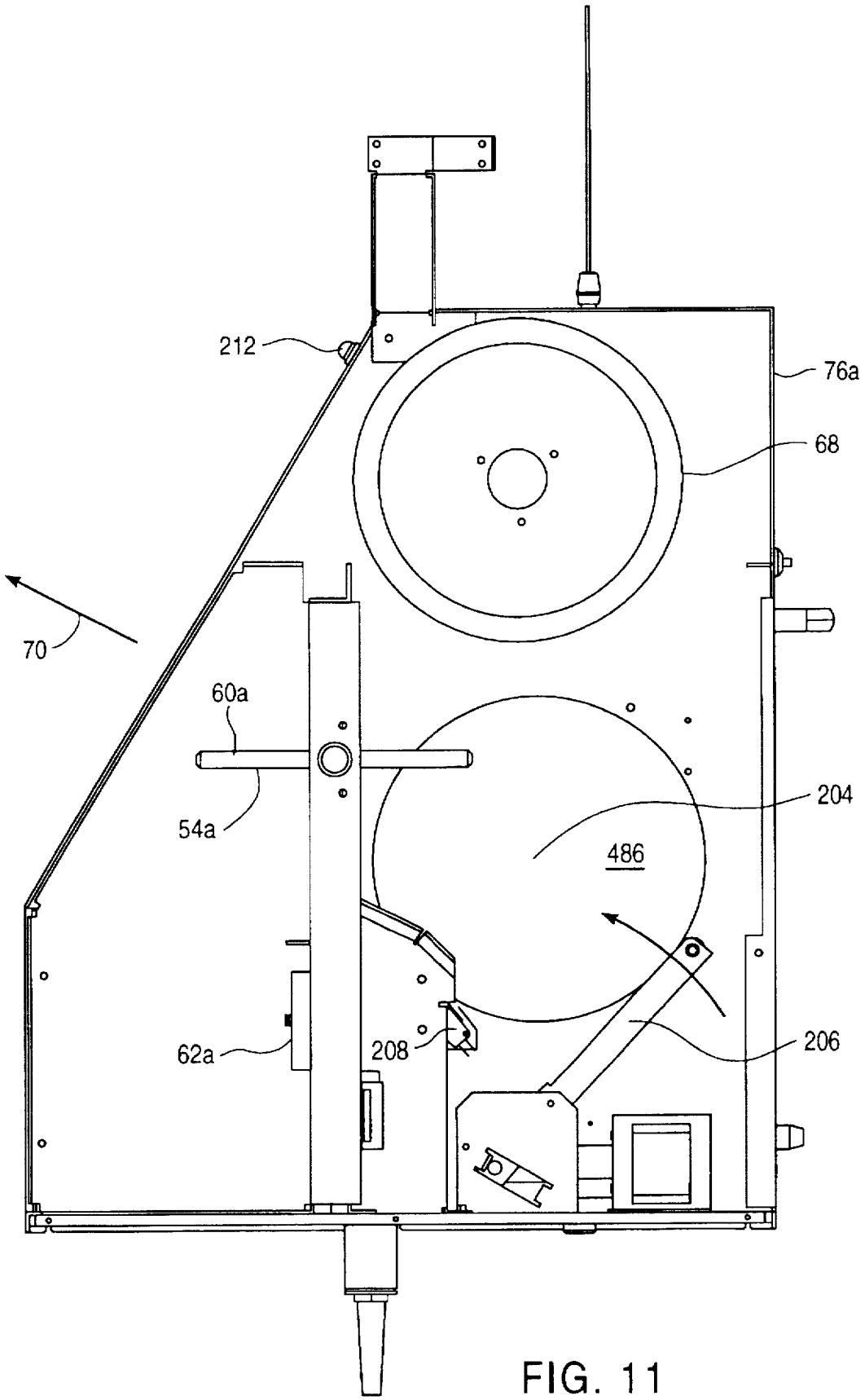
FIG. 11 is an enlarged view of a portion of the passing machine of FIG. 9 with portions removed to show internal components.

FIGS. 8–16 illustrate a second embodiment of a basketball collection, passing and shot analysis system made according to the invention with like reference numerals referring to like elements. System 2*a* includes broadly a free-standing collection net assembly 16*a* and a basketball passing machine 18*a*. Referring now primarily to FIGS. 9–11, machine 18*a* will be described in more detail.

Machine 18*a* is similar to machine 18. Machine 18*a* includes a cart 200 supported by lockable caster wheels 31*a* and supporting a manually rotatable turntable 30*a*. Turntable 30*a* supports body 28*a* of basketball passing machine 18*a*. Body 28*a* includes a generally U-shaped handle 202 which surrounds three sides of body 28*a*. Handle 202 is used to move basketball passing machine 18*a*, with caster wheels 31*a* unlocked, and rotate body 28*a* about vertical axis 93 to change the azimuth or direction of the passes.

Display 92*a* is similar to display 92 of the first embodiment but includes only three fields, balls in play field 94, shots made field 96 and percentage of shots made field 98.

With the second embodiment balls released by paddle wheel 60*a* do not pass directly to a position at outlet 46*a* between passing rollers 66, 68. Rather, basketballs 48 drop from an elevated position at exit 56*a* of basketball supply 20*a* (basketball 48*a*) to a staging position 204 (basketball 48*b*) as shown in FIGS. 9 and 11. When at staging position 204, basketball 48 rests against a pivotal pusher 206 and a microswitch 208. Depression of microswitch 208 sends a signal to the controller that a basketball is in position for ejection by passing rollers 66, 68. When it is time for the basketball to be passed along trajectory 70, such as can occur by the player pressing player's remote 80, or after the elapse of a sufficient length of time between passes, such as 3.5 seconds, pusher 206 rotates from the position of FIG. 11 to the left thus driving basketball 48 into contact with spinning passing rollers 66, 68. When so engaged by rollers 66*a*, 68*a*, basketball 48*b* is discharged or passed along trajectory 70. Generation of a ball-in-play signal occurs at the same time as activation of pusher 206. After moving basketball 48 from staging position 204 to output 46*a* between passing rollers 66, 68, pusher 206 quickly moves back to the position of FIG. 11 awaiting the next basketball 48*a* to be released by paddle wheel 60*a*.

Body 28*a* includes a pair of indicator lights 210, 212. Light 210 is a green light and is illuminated whenever passing machine 18*a* is energized, that is, whenever passing rollers 66, 68 are turning. Indicator light 212 is a red light and is illuminated for a brief period of time whenever pusher 206 is actuated to indicate a pass is imminent.

Collection net assembly 16*a* includes a freestanding collection net frame 32*a* and netting 34*a*. Netting 34*a* is largely removed from FIGS. 12–16 so as not to obscure the elements of frame 32*a*. Note that collection net frame 32*a*, and its associated collection net 34*a*, can be used with either of passing machines 18 or 18*a*.

Figure 12:
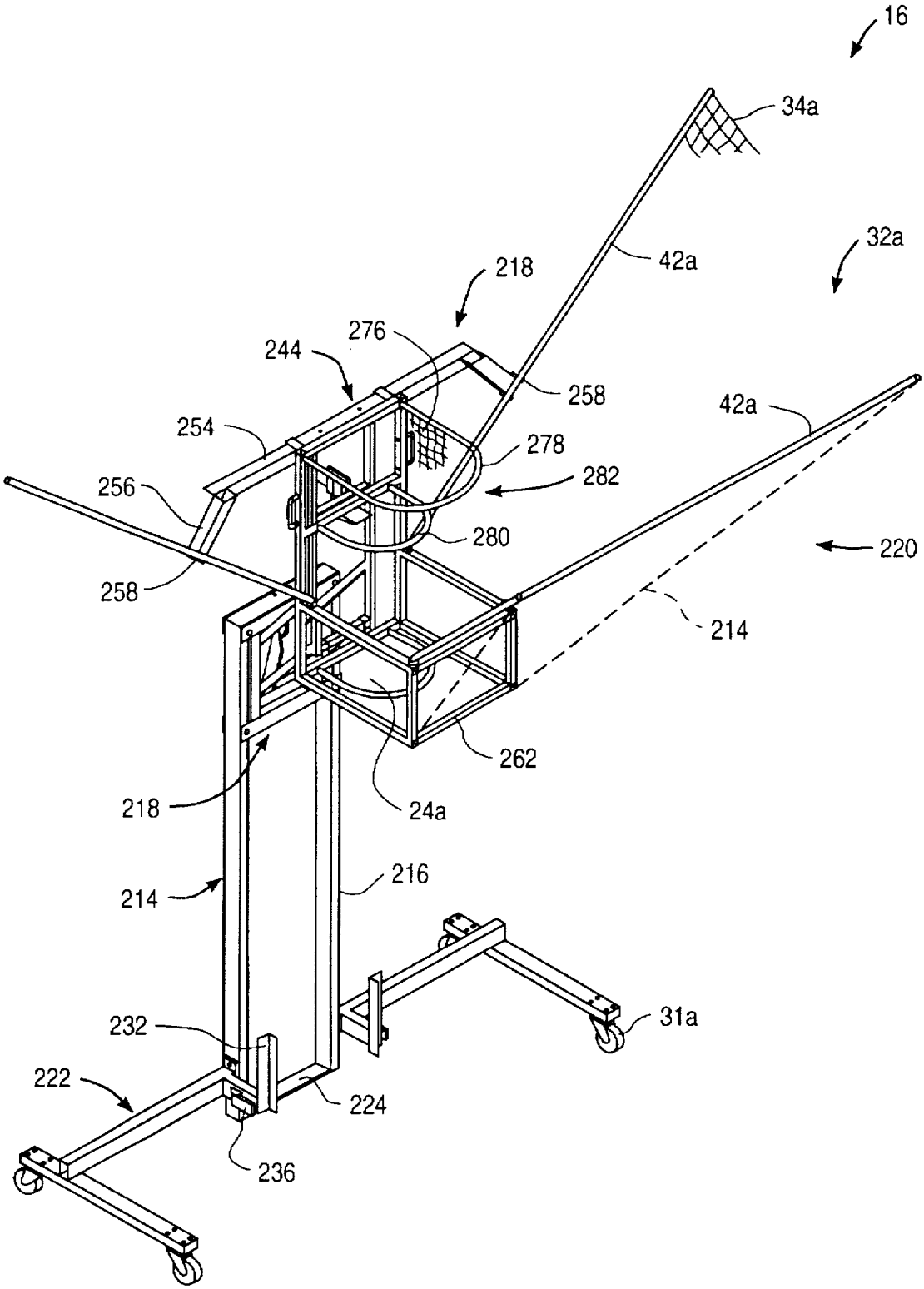
FIGS. 12 and 12A are front and rear perspective views of the frame of the collection net assembly of FIG. 8, with substantially all of the collection net removed for clarity.
Figure 13:
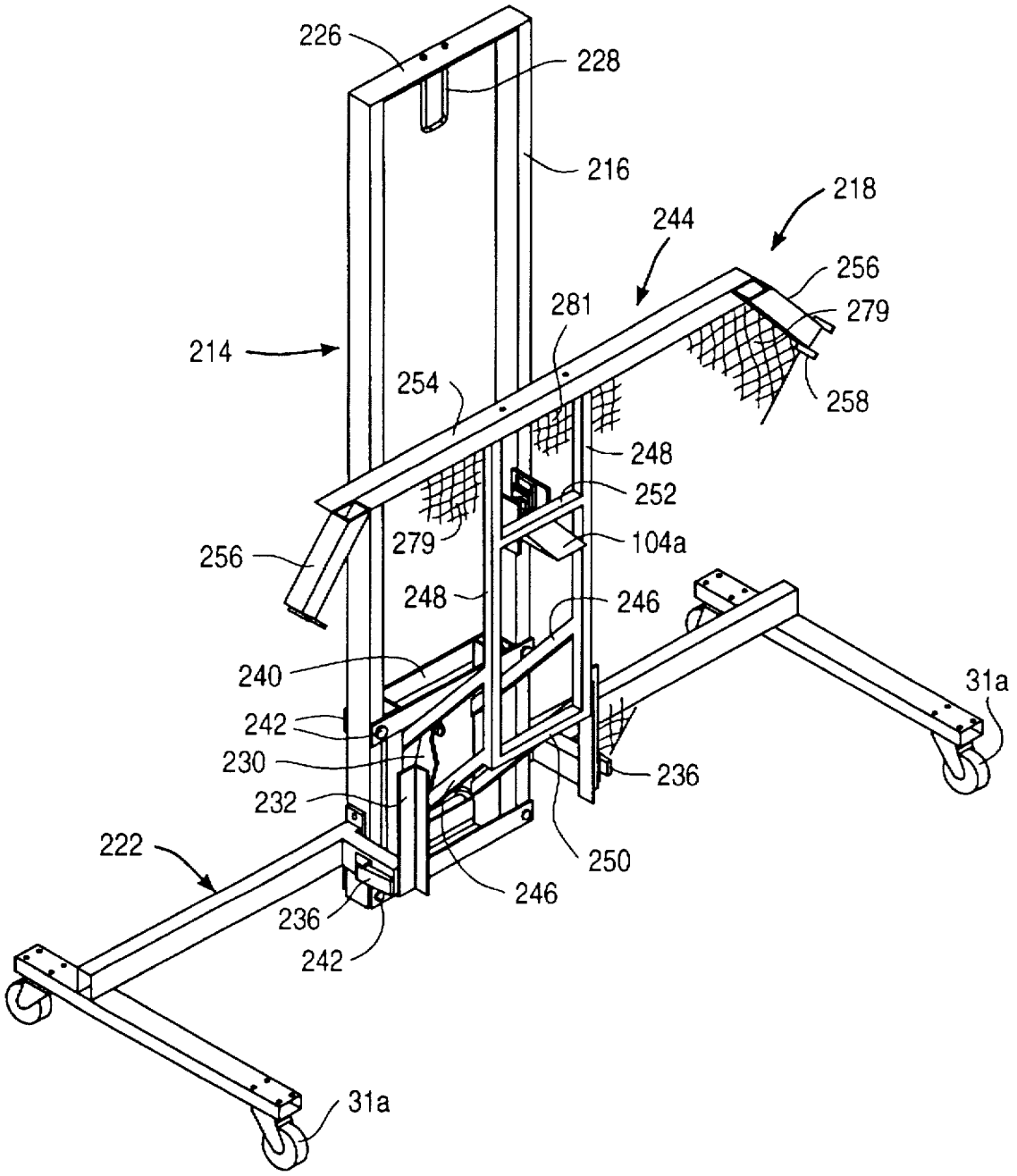
FIG. 13 illustrates the support frame and lift frame of FIG. 12 with the lift frame in the lowered or storage position and the netting frame assembly removed.

Collection net frame 32*a* includes a support frame 214, having a pair of vertical supports 216, a lift frame 218 mounted to vertical supports 216 for movement between a raised or use position of FIG. 12 and a lowered or stored position of FIG. 13, and a netting frame assembly 220 removably mounted to lift frame 218.

Support frame 214 includes a base 222 supported by lockable caster wheels 31*a* and from which vertical supports 216 extend. The base ends of vertical supports 216 are coupled by a footplate 224 positioned adjacent to the floor. Footplate 224 permits a user to place his or her foot on footplate 224 and stabilize support frame 214 when lifting lift frame 218, and netting frame assembly 220 therewith, from the lowered or storage position of FIG. 16 to the raised or use position of FIG. 12.

Figure 12A:
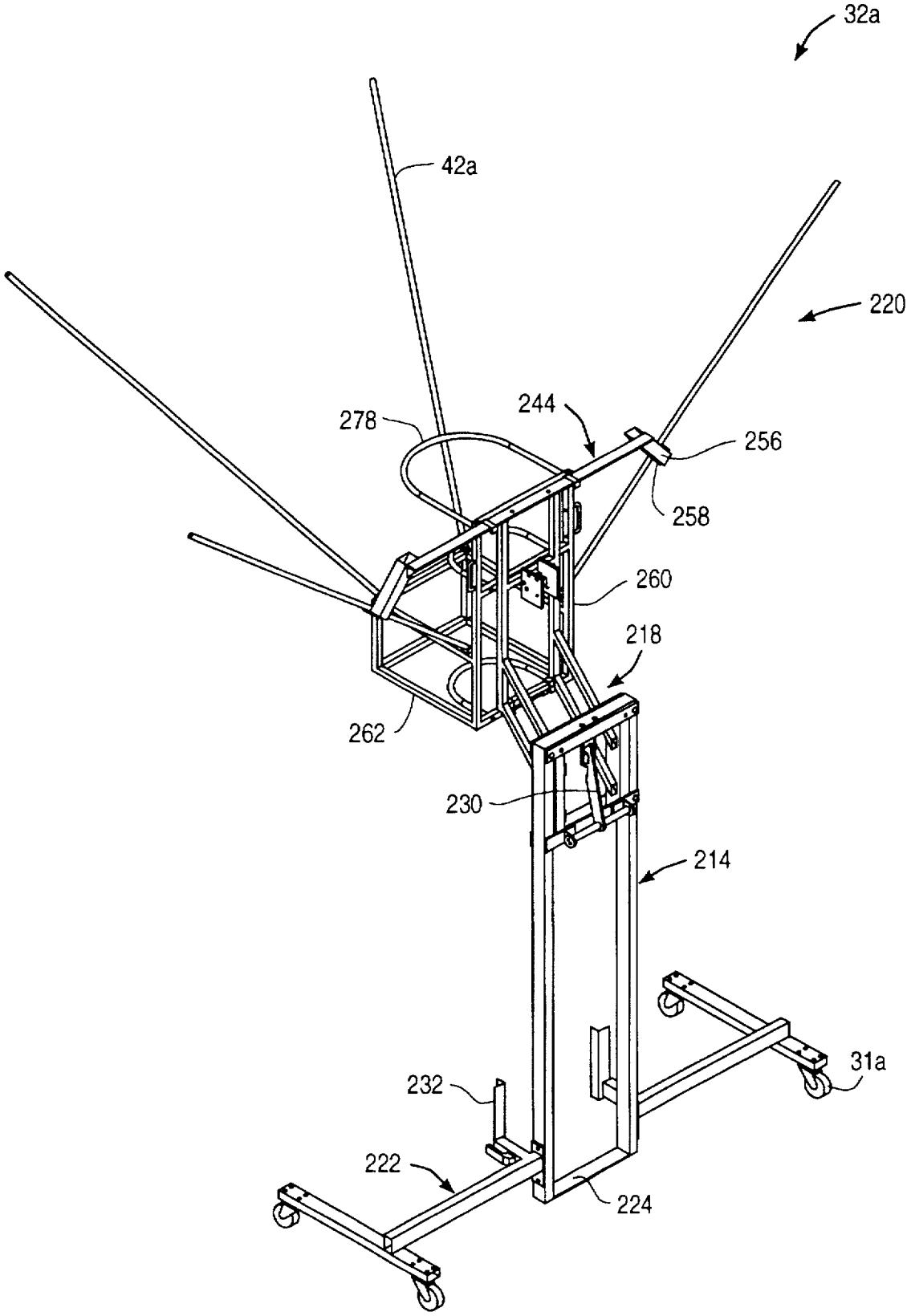

The upper ends of vertical supports 216 are coupled together by a bar 226 from which a hook support bracket 228 depends. Hook support bracket 228 is sized and positioned to permit a hook 230 of lift frame 218 to engage the support bracket so to keep lift frame 218 in the raised or use position of FIGS. 12 and 12A.

Base 222 includes a pair of docking guides 232 sized and positioned to engage a pair of opposed legs 234 of cart 200. Clamps 236 are mounted adjacent to docking guides 232 and are configured to engage clamping tabs 238 secured to legs 234. This permits basketball passing machine 18*a* to be clamped securely to collection net frame 32*a*.

Lift frame 218 includes a support guide assembly 240 having low friction guides 242 which ride along vertical supports 216 of support frame 214 as lift frame 218 moves between the lowered and raised positions. Once in the raised position, hook 230 is moved to engage hook support bracket 228 to maintain lift frame 218 in the raised or use position. See FIG. 12A.

Lift frame 218 also includes a support structure 244 to which netting frame assembly 220 is mounted. Support structure 244 includes upwardly and outwardly extending arms 246 extending from support guide assembly 240 and supporting a pair of vertical bars 248. Bars 248 are connected at their lower ends to a lower connecting bar 250, are coupled along their lengths by an intermediate connecting bar 252, and are connected at their upper ends by a main support bar 254. Main support bar 254 has a pair of downwardly and outwardly angled arms 256 with outwardly extending supports 258 at the distal ends of arms 256. Supports 258 are used to provide support for the two innermost supporting arms 242*a* as shown in FIG. 12. Intermediate connecting bar 252 is used to support a shot made sensor 104*a* in the form of a spring-biased paddle which is biased to the generally horizontal position of FIGS. 12 and 13 but is deflectable downwardly by a basketball 48 which has passed through hoop 10 and net 14 as is discussed below.

Figure 14:
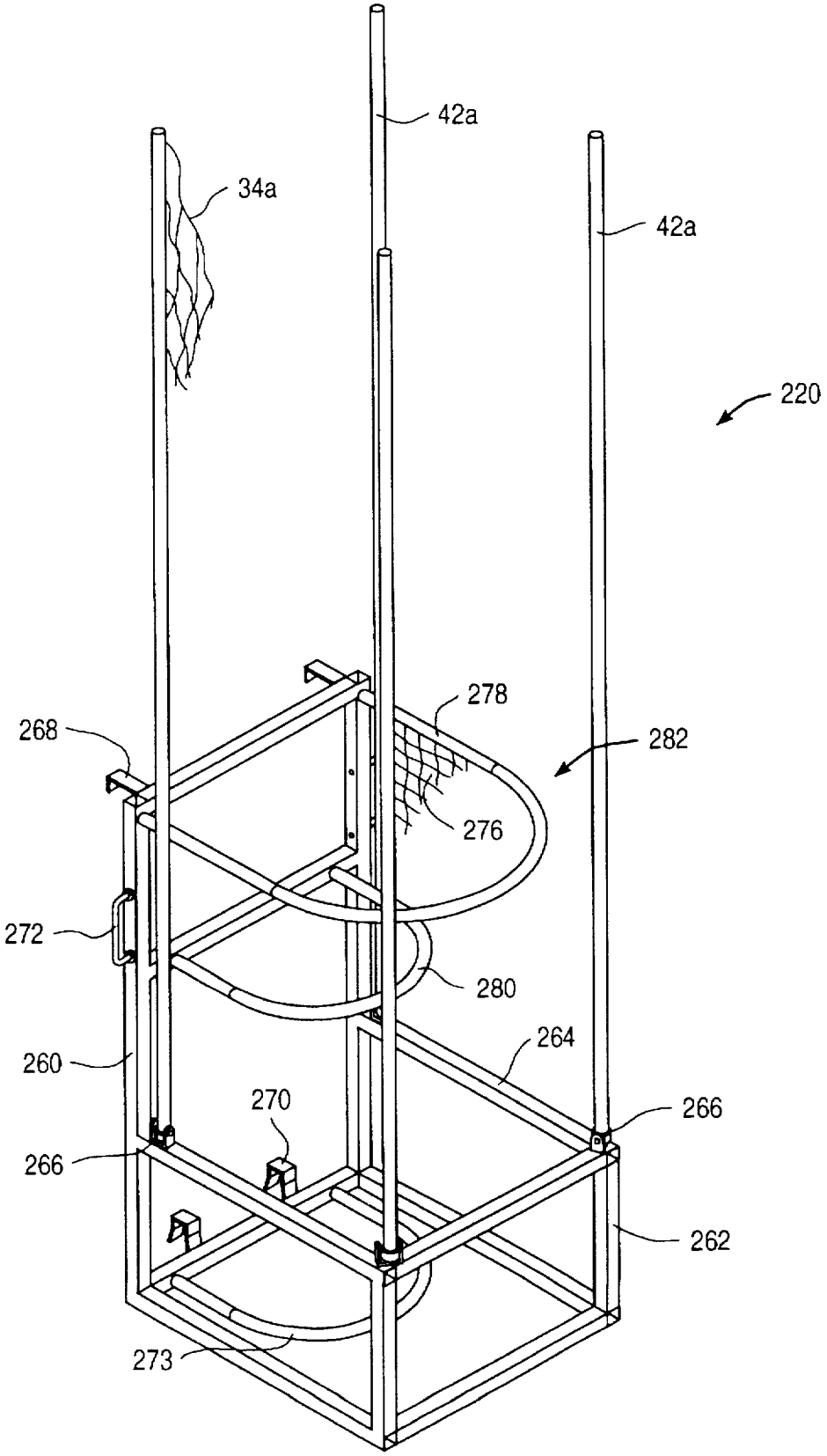
FIG. 14 illustrates the netting frame assembly before mounting to the lift assembly of FIG. 13.

FIG. 14 illustrates netting frame assembly 220 with arms 42*a* in their upright or storage position. Assembly 220 includes a generally vertically oriented rectangular base frame 260 and a box frame 262 extending from the lower end of base frame 260. Arms 42*a* are mounted at the corners of an upper member 264 of box frame 262 by pivots 266. Base frame 260 has pairs of hooks 268, 270 extending from the upper and lower portions of the base frame. Hooks 268, 270 are sized and positioned to engage main support bar 254 and lower connecting bar 250 of support structure 244, respectively. Mounting netting frame assembly 222 to and from lift frame 218 is aided by the provision of a pair of handles 272 on base frame 260. To keep arms 42*a* from pivoting outwardly during mounting, dismounting, moving and storage appropriate tethers, fasteners or elastic cords can be used to maintain the arms in their generally upright positions of FIG. 14. Netting 34*a* is attached to arms 42*a* and extends from the upper distal ends of arms 42*a* downwardly to a U-shaped net keeper 273.

Figure 15:
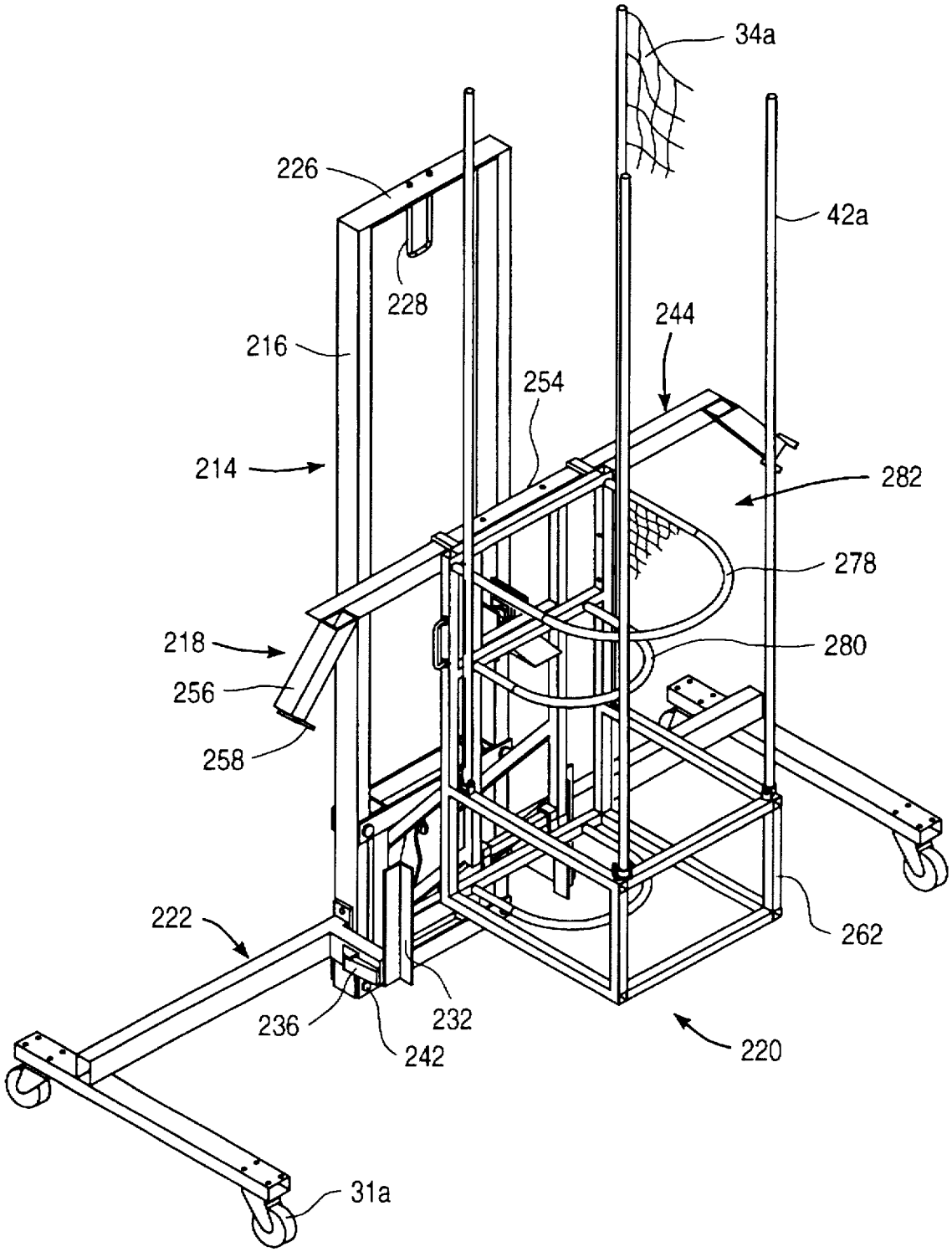
FIG. 15 illustrates the result of mounting the netting frame assembly of FIG. 14 to the lift frame of FIG. 13.
Figure 16:
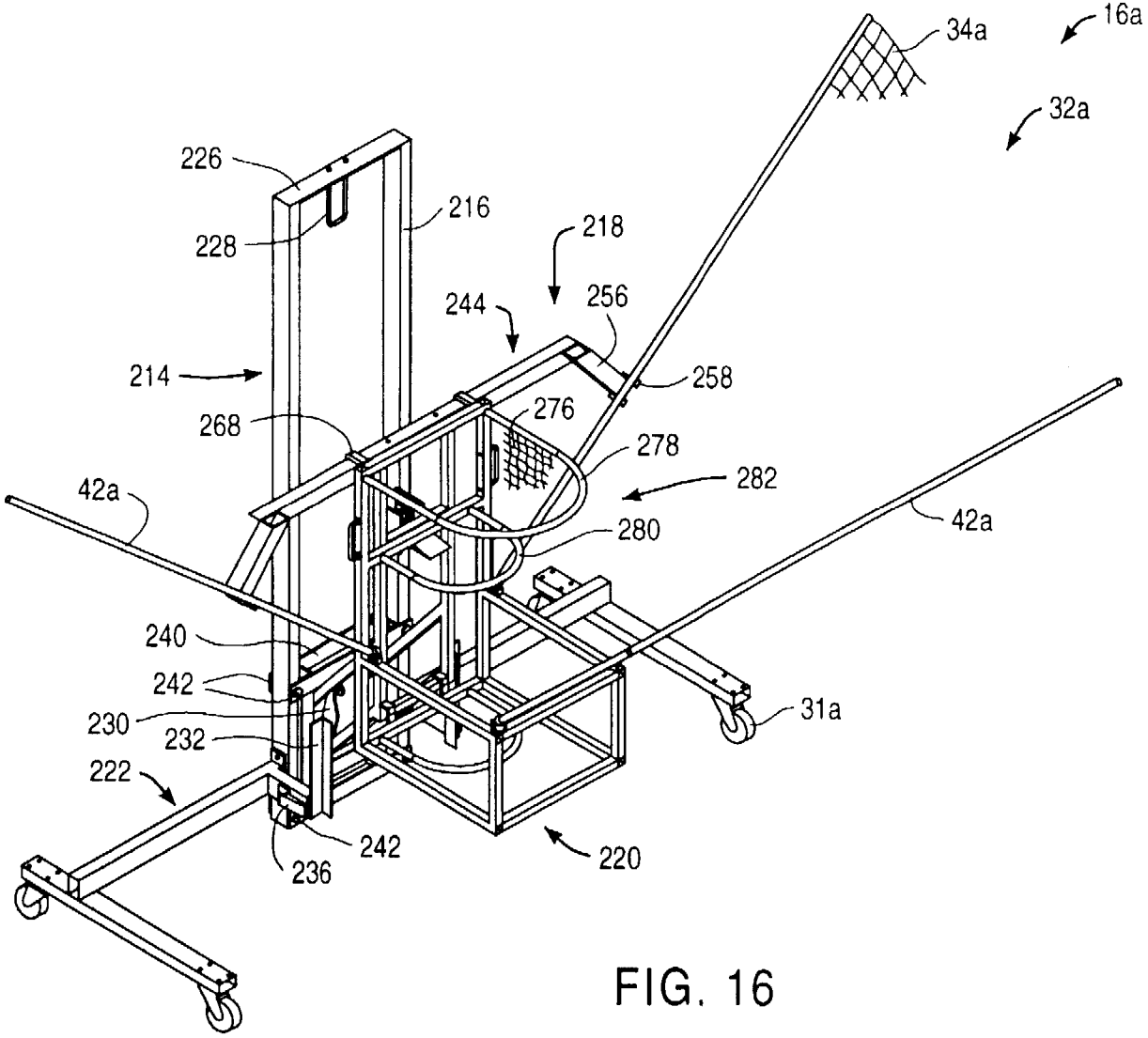
FIG. 16 illustrates the frame of the collection net assembly of FIG. 15 with the supporting arms pivoted outwardly in preparation for raising the lift frame and the netting frame assembly and netting therewith to the raised, use position of FIG. 12.

FIG. 15 illustrates how netting frame assembly 220 looks when first mounted to lift frame 218. Next, arms 34*a* are allowed to pivot outwardly to the positions of FIG. 16. It should be noted that two of the arms 34*a* have their outward movement limited by supports 258 at the end of arms 256. The user then raises the combination of lift frame 218 and netting frame 220, with netting 34 secured to the netting frame assembly from the lowered position of FIG. 16 to the raised position of FIG. 12. At this point tensioning straps 274 are secured between the distal ends of two outermost supporting arms 42*a* and box frame 262. This places netting 34*a* in tension, forces the two outermost arms 42*a* against supports 258 and maintains the collection net in the stable, use position of FIG. 8.

FIGS. 8 and 12 also illustrate the use of netting 276 mounted between a pair of U-shaped members 278, 280. Shot made sensor 104*a* is generally aligned with the lowermost U-shaped member 280. Members 278, 280 and netting 276 are sized and positioned to lie directly beneath hoop 10 and net 14 so that only made shots pass through the shot made guide 282 formed by members 278, 280 and netting 276. Shot made sensor 104*a* is positioned so that all basketballs which pass through shot made guide 282 engage sensor 104*a* thus causing sensor 104*a* to deflect and produce a shot made signal. In this second embodiment, sensor 104*a* is hard-wired to the controller. Appropriate connectors extending from the base of netting frame assembly 220 and entrance 22*a* of basketball supply 20 are hooked together once passing machine 18*a* is clamped to support frame 214 using clamps 236.

Once collection net assembly 16*a* is in position with main support bar 254 abutting backboard 6, caster wheels 31*a* are locked to maintain the collection net assembly 16*a* in position. Passing machine 18*a* is then secured to support frame 214 using clamps 236 and clamping tabs 238. Tensioning straps 274 are tightened, if necessary. The appropriate connection is made between shot made sensor 104*a* to the controller and basketball passing machine 118*a* is then connected to an electrical outlet. Netting 279, see FIG. 13, is suspended between main support bar 254, arms 256 and bars 248 on each side of support structure 244. Netting 281 is suspended between parallel bars 248, support bar 254 and lower connecting bar 250.

Figure 9A:
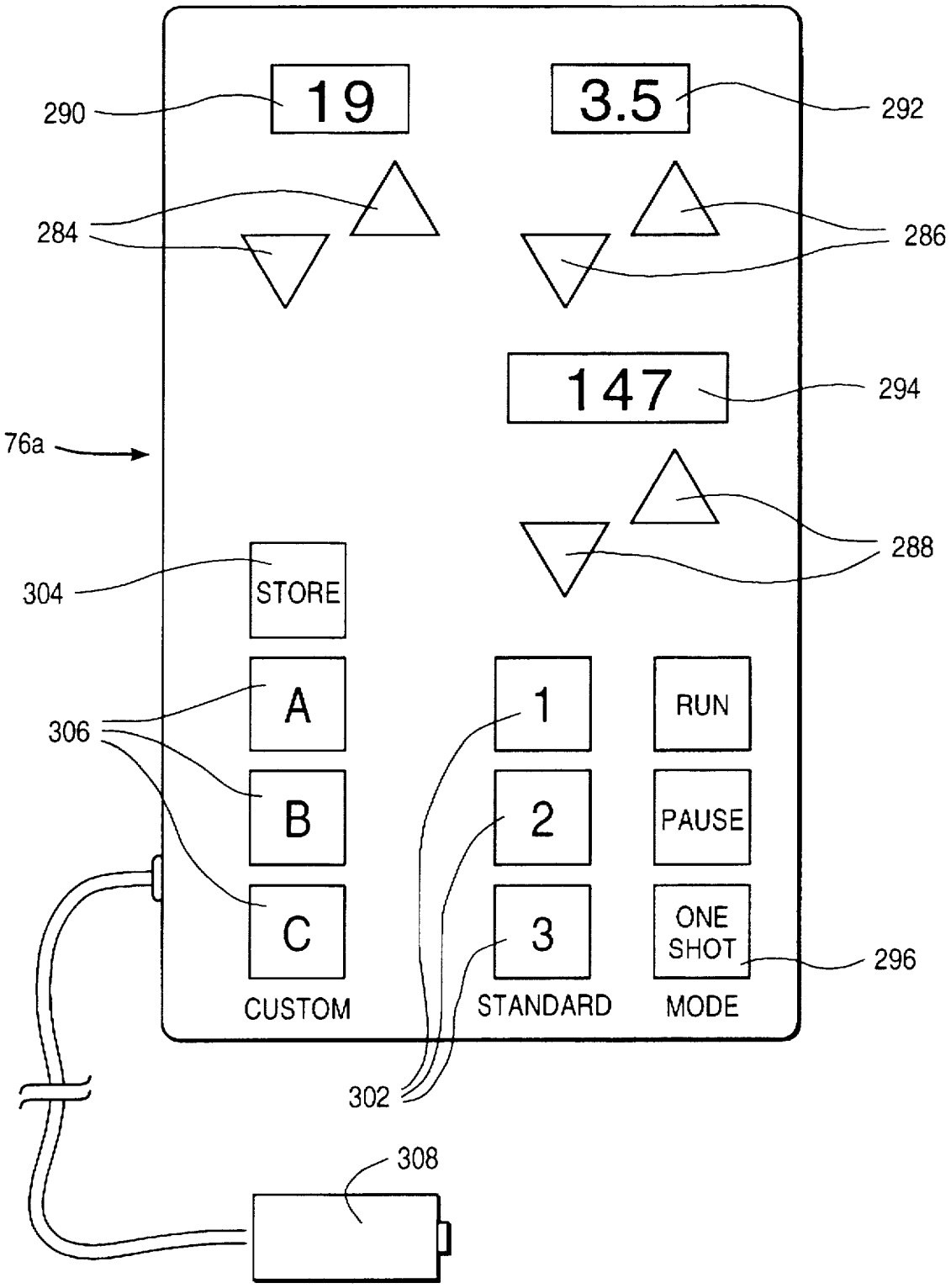
FIG. 9A is an enlarged view of an input panel mounted to the body of the passing machine of FIG. 9.

Referring now to FIG. 9A, input panel 76*a* is used to set the passing pattern. The passing pattern can be input manually using distance keypads 284, interval keypads 286 and total shots keypads 288. The input amounts are shown on distance display 290, interval display 292 and shots remaining display 294. During a drill the distance and interval values will remain the same as successive balls are discharged but the information shown on the shots remaining display 294 will count down for each ball placed in play. Input 76 also preferably includes mode selections including one shot 296, pause 298 and run 300 buttons. Input panel 76*a* is provided with three pre-programmed shot sessions, such as 100 shots from the foul line every 3.5 seconds. Customized shot sessions can be stored by the user through the use of store button 304 and three different custom shot session buttons 306. In the one-shot mode, pusher 206 is actuated manually through the use of a remote controller, typically player's remote 80, or by a pushbutton switch 308 hardwired to input panel 76*a*. Input panel 76*a* is mounted to body 28*a* towards the upper end opposite indicator lights 210, 212 as suggested in FIG. 11 to ensure the person inputting the information is well away from outlet 46*a* and the path of basketballs 48 as they are ejected along trajectory 70.

Modification and variation can be made to the disclosed embodiments without departing from the subject of the invention as defined in the following claims. For example, basketball ejector assembly 26 could use means other than rotating rollers 66, 68 to pass basketball 48, such as plungers to punch the ball towards the player or arms to toss the ball towards the player. Also, the exit of basketball supply 20 could be positioned adjacent to driving rollers 66, 68 to permit a greater number of basketballs to be held within basketball supply region 50; the basketballs would then be given a slight push, such as with a solenoid-actuated pusher, to enter into the region between the driving rollers 66, 68 rather than rely on gravity feed as in the first embodiment. Also, the use of a separate metering assembly, such as basketball metering assembly 52, could be eliminated if the assembly which actually drives the basketball along trajectory 70 could be turned on and off. For example, if it were possible to position a basketball 48 between driving roller 66, 68 when the driving rollers were stationary and quickly energize the driving rollers to expel the basketball along trajectory 70 with sufficient speed, metering assembly 52 would not be needed since that function would be taken up by the selected actuation of the driving rollers. Similarly, a basketball metering assembly may not be needed if the ball were to be projected by, for example, a throwing arm or a punching piston. Passing machine 18 could be positioned away from basket 9; in this case a pair of downwardly inclined rails (not shown) could be connected between basketball discharge guide 36 and the upper end of basketball guide frame 44 to direct basketballs into supply region 50. Safety proximity sensors may also be used to ensure a basketball is not discharged when a person or object is aligned with and too close to the outlet of the basketball ejector assembly. One or more shots-missed sensors can be used to increase the accuracy of make-streak and miss-streak information.

What is claimed is:

1. A basketball passing machine comprising:

a body;

a basketball supply, mounted to the body, comprising a basketball supply region having an entrance, through which basketballs are introduced into the supply region, the basketball supply region sized and configured to hold at least two basketballs;

a basketball ejector assembly, mounted to the body and operably coupled to the basketball supply region, arranged and adapted to pass basketballs, one-at-a-time and in a controlled manner, from the basketball supply along a trajectory directed away from said machine; and said basketball ejector assembly comprising:

first and second passing rollers having basketball-engaging surfaces; and a basketball metering assembly which supplies basketballs one-at-a-time and in a controlled manner along a path to a discharge position between and engagable with the first and second rollers, said basketball metering assembly comprising a rotatable paddle-wheel having arms engagable with said basketballs and a paddle-wheel rotation limiter for limiting rotation of said paddle-wheel to a chosen rotary movement.

2. The machine according to claim 1, wherein the body has support wheels to facilitate movement of said machine.

3. The machine according to claim 2, wherein said support wheels are lockable caster wheels.

4. The machine according to claim 1, wherein the basketball supply region is sized and configured to hold at least four basketballs.

5. The machine according to claim 1, wherein the basketball supply comprises a basketball magazine defining a basketball supply path so that said basketballs are arranged in a line along the basketball supply path.

6. The machine according to claim 1, wherein said trajectory has an angular elevation and an azimuth.

7. The machine according to claim 6, wherein the azimuth of the trajectory is a changeable azimuth.

8. The machine according to claim 6, further comprising a controller controlling the operation of the basketball ejector assembly to create a programmable basketball passing machine.

9. The machine according to claim 6, further comprising means for passing a chosen number of basketballs at a selected azimuth to a selected position at a selected rate.

10. The machine according to claim 9, further comprising means for actuating said basketball ejector assembly to pass basketballs at said selected rate.

11. The machine according to claim 6, further comprises means for automatically changing the azimuth of the trajectory.

12. The machine according to claim 11, wherein the azimuth changing means includes a turntable mounted to the body and on which the basketball ejector assembly is supported.

13. The machine according to claim 1, wherein said body comprises a manually rotatable turntable mounted to the body and on which the basketball ejector assembly is supported.

14. The machine according to claim 1, wherein the rotational speeds of said rollers are adjustable so to change the speed of a basketball passed from said basketball ejector assembly.

15. The machine according to claim 14, wherein the rotational speeds of the passing rollers are individually adjustable to permit a selected spin to be imparted to said basketball passed from said basketball ejector assembly.

16. The machine according to claim 1, wherein said basketball metering assembly comprises a basketball pusher at an intermediate position along the path which pushes basketballs towards the discharge position.

17. The machine according to claim 16, wherein said intermediate position is at a lower elevation than either of the paddle-wheel or the discharge position.

18. The machine according to claim 17, wherein said basketball ejector assembly comprises a basketball sensor at said intermediate position which senses the presence of a basketball.

19. The machine according to claim 1, further comprising means for automatically actuating said basketball ejector assembly to pass basketballs at a chosen rate.

20. The machine according to claim 1, wherein the basketball ejector assembly comprises a basketball ejector adapted pass basketballs supplied thereto along the trajectory.

21. The machine according to claim 20, wherein the basketball supply has an exit, said exit being at a higher elevation than the basketball ejector so that said basketballs move from the basketball supply to the basketball ejector by gravity.

22. A basketball passing machine and shot analysis system comprising:

a basketball collection net assembly, positionable adjacent a basketball backboard, comprising a frame and downwardly converging netting supported by the frame, the collection net assembly having a basketball discharge opening;

the frame of the basketball collection net assembly being a floor-supported frame, said floor-supported frame comprising:

a support frame comprising a vertical support with upper and lower ends;

a lift frame slidably mounted to the vertical support for movement between an upper, use position and a lower, storage position; and a netting frame assembly mounted to the lift frame, the netting frame assembly comprising a netting frame and supporting arms pivotably mounted to and extending from the netting frame, said netting secured to the supporting arms;

a basketball passing machine comprising:

a body;

a basketball supply, mounted to the body, comprising a basketball supply region having an entrance, through which basketballs are introduced into the supply region from the basketball collection net assembly, the basketball supply region sized and configured to hold at least two basketballs; and a basketball ejector assembly, mounted to the body and operably coupled to the basketball supply, arranged and adapted to pass basketballs, one-at-a-time and in a controller manner, from the basketball supply along a trajectory.

23. The system according to claim 22, wherein the basketball collection net assembly further comprises backboard hanger brackets extending from the frame.

24. The system according to claim 22, wherein said floor-supported frame is sized and the netting frame assembly is sized and is removably mounted to the lift frame so that the floor supported frame can pass through a 80×32 inch doorway when the netting frame assembly is dismounted from the lift frame and the lift frame is in the lower, storage position, and so that the netting frame assembly can pass through said doorway when dismounted from the lift frame.

25. The system according to claim 22, further comprising a shot-made sensor mounted to the basketball collection net assembly.

26. The system according to claim 25, wherein said basketball collection net assembly comprises a shot-made basketball collector configured to direct a chosen group of basketballs to the shot-made sensor.

27. The system according to claim 26, wherein said shot-made basketball collector comprises a shot-made netting support and downwardly and inwardly directed shot-made netting supported by the shot-made netting support.

28. The system according to claim 22, wherein the entrance of said basketball supply is positioned below the basketball discharge opening so that both missed and made shots result in basketballs being directed into the basketball supply.

29. The system according to claim 22, further comprising a shot-made sensor assembly comprising:

a tension sensor operably coupled to the basketball passing machine; and a basketball net support wire coupled to the tension sensor so that increased tension on the support wire is sensed by the tension sensor to generate a shot-made signal.

30. The system according to claim 29, wherein the tension sensor comprises a Hall-effect sensor mounted to a case, the case housing a spring-biased magnet positioned in the proximity of the Hall-effect sensor and connected to the support wire so that increased tension of the support wire causes the magnet to move causing the Hall-effect sensor to produce a shot-made signal.

31. The system according to claim 22, further comprising means for generating a made-shot signal.

32. The system according to claim 31, further comprising means for generating a ball-in-play signal.

33. The system according to claim 32, wherein said ball-in-a-play signal is generated for each time a basketball is passed from said basketball ejector assembly.

34. The system according to claim 32, further comprising means for computing shot information based on said made-shot and ball-in-play signals.

35. The system according to claim 34, further comprising means for printing said shot information.

36. The system according to claim 34, further comprising a shot information display coupled to the shot information computing means.

37. The system according to claim 34, wherein said shot information comprises the following: number of balls in play, number of shots made and percentage of shots made to balls-in-play.

38. The system according to claim 37, wherein said shot information further comprises current shots made streak and longest shot-made streak.

39. The system according to claim 37, wherein said shot information further comprises time to take shot information computed from the elapse of time between ball-in-play signals and corresponding made-shot signals.

40. A basketball collection net assembly, positionable adjacent a basketball backboard, comprising:

a floor-supported frame;

downwardly converging netting;

said floor-supported frame comprising:

a support frame comprising a vertical support with upper and lower ends;

a lift frame slidably mounted to the vertical support for movement between an upper, use position and a lower, storage position; and a netting frame assembly mounted to the lift frame, the netting frame assembly comprising a netting frame and supporting arms pivotably mounted to and extending from the netting frame, said downwardly-converging netting secured to the supporting arms; and the collection net assembly having a basketball discharge opening.

41. The assembly according to claim 40, wherein said floor-supported frame is sized and the netting frame assembly is sized and is removably mounted to the lift frame so that the floor supported frame can pass through a 80×32 inch doorway when the netting frame assembly is dismounted from the lift frame and the lift frame is in the lower, storage position, and so that the netting frame assembly can pass through said doorway when dismounted from the lift frame.

42. The assembly according to claim 40, further comprising a shot-made sensor mounted to the frame.

43. The assembly according to claim 42, further comprising a shot-made basketball collector configured to direct a chosen group of basketballs to the shot-made sensor.

44. The assembly according to claim 43, wherein said shot-made basketball collector comprises a shot-made netting support and downwardly and inwardly directed shot-made netting supported by the shot-made netting support.

* * * * *